US007797968B2

(12) United States Patent
Chuang et al.

(10) Patent No.: US 7,797,968 B2
(45) **Date of Patent: *Sep. 21, 2010**

(54) METHOD TO MAKE CIRCULAR KNIT ELASTIC FABRIC COMPRISING SPANDEX AND HARD YARNS

(75) Inventors: Cheng-Yuan Chuang, Panchiao City (TW); Graham H. Laycock, Grangeford (SG); Raymond S. P. Leung, New Territories (HK); Peter George Szanto, Lincoln University, PA (US); Fred Wynegar, Wilmington, DE (US)

(73) Assignee: INVISTA North America s.à.r.l., Wilmington, DE (US)

( * ) Notice: Subject to any disclaimer, the term of this patent is extended or adjusted under 35 U.S.C. 154(b) by 1440 days.

This patent is subject to a terminal disclaimer.

(21) Appl. No.: 11/202,735

(22) Filed: Aug. 12, 2005

(65) Prior Publication Data

US 2006/0021387 A1 Feb. 2, 2006

Related U.S. Application Data

(63) Continuation-in-part of application No. PCT/US2004/017364, filed on Jun. 1, 2004.

(51) Int. Cl.
*D04B 1/18* (2006.01)

(52) U.S. Cl. ..... 66/198

(58) Field of Classification Search ..... 66/192, 66/195, 202, 16; 442/306, 304, 313
See application file for complete search history.

(56) References Cited

U.S. PATENT DOCUMENTS 3,392,552 A 7/1968 Muller et al.
4,875,241 A 10/1989 Browder et al.
5,198,288 A 3/1993 Grunfeld
5,584,196 A 12/1996 Taylor et al.
5,687,587 A * 11/1997 Michel ..... 66/196
5,815,868 A * 10/1998 Lee ..... 8/151.2
5,931,023 A * 8/1999 Brach et al. ..... 66/136

(Continued)

FOREIGN PATENT DOCUMENTS

EP 0119536 9/1986

(Continued)

OTHER PUBLICATIONS

International Search Report for PCT/US2004/017364.

(Continued)

*Primary Examiner*—Danny Worrell
(74) *Attorney, Agent, or Firm*—Christina W. Geerlof

(57) ABSTRACT

Circular knit, elastic fabrics of at least one of single jersey, French terry, and fleece are disclosed that include a bare elastomeric material plated with spun and/or continuous filament hard yarns. The circular knit, elastic fabrics of at least one of single jersey, French terry, and fleece are manufactured by a method that does not require a dry heat setting step. The method requires drafting the bare elastomeric material no more than about 7× its original length when knitting to form the circular knit, elastic, single jersey, French terry, or fleece fabric. The method includes contacting the knit fabric with an aqueous solution under very low tension and under conditions of temperature and pressure for a period of time sufficient to substantially set the elastomeric material.

19 Claims, 6 Drawing Sheets

U.S. PATENT DOCUMENTS

| | | | | |
|---|---|---|---|---|
| 5,948,875 | A * | 9/1999 | Liu et al. | 528/61 |
| 6,129,876 | A * | 10/2000 | Qin et al. | 264/209.5 |
| 6,263,707 | B1 * | 7/2001 | Miller et al. | 66/171 |
| 6,263,797 | B1 | 7/2001 | Brice | |
| 6,458,166 | B1 | 10/2002 | Fleissner | |
| 6,472,494 | B2 * | 10/2002 | Houser et al. | 528/61 |
| 6,776,014 | B1 * | 8/2004 | Laycock et al. | 66/198 |
| 6,846,866 | B2 | 1/2005 | Houser et al. | |
| 7,040,124 | B1 * | 5/2006 | Miller et al. | 66/202 |
| 7,117,695 | B2 * | 10/2006 | Laycock et al. | 66/198 |

FOREIGN PATENT DOCUMENTS

| | | |
|---|---|---|
| EP | 0369822 | 5/1990 |
| EP | 1375717 | 1/2004 |
| EP | 1437432 | 7/2004 |

OTHER PUBLICATIONS

DuPont: "Single Jersey Fabrics with LYCRA" Technical Bulletin L410, Jan. 24, 2001 (Feb. 24, 2001), pp. 1014.

DuPont: "Wet Processing of Fabrics Containing LYCRA Elastane" Technical Bulletin L704, Oct. 15, 1999, pp. 1-21.

DuPont: "Dyeing and Finishing Circular Knit Fabrics with LYCRA" Technical Bulletin L713 Replaces Bulletin L712, 1999, pp. 1-29.

* cited by examiner

METHOD TO MAKE CIRCULAR KNIT ELASTIC FABRIC COMPRISING SPANDEX AND HARD YARNS

CROSS REFERENCE TO RELATED APPLICATIONS

This application is a continuation-in-part of International Application PCT/US2004/017364, designated in the United States and filed Jun. 1, 2004; which PCT application claims benefit under 35 U.S.C. §365(c) of U.S. application Ser. No. 10/454,746, filed Jun. 2, 2003, now U.S. Pat. No. 6,776,014.

This application also claims benefit under 35 U.S.C. 119(e) of provisional applications U.S. Ser. No. 60/668,360 (LP-5755), filed Apr. 4, 2005; U.S. Ser. No. 60/613,429 (LP-5680), filed Sep. 27, 2004; and U.S. Ser. No. 60/637,815 (LP-5680), filed Dec. 21, 2004.

The entire contents of each of the above-referenced applications are hereby expressly incorporated herein by reference.

STATEMENT REGARDING FEDERALLY SPONSORED RESEARCH OR DEVELOPMENT

Not Applicable.

BACKGROUND OF THE INVENTION

1. Field of the Invention

This invention relates to circular knitting yarns into fabrics, and specifically to circular knit, elastic fabrics of at least one of single jersey, French terry, and fleece comprising both spun and/or continuous filament hard yarns, and bare elastomeric yarns. In particular, the presently claimed and disclosed invention relates to fabrics that have been circular knitted in a manner in which the draft of the bare elastomeric yarn is controlled and in which a hydro-setting step is utilized to provide a finished fabric having predefined use characteristics without the need for an additional dry heat setting step.

2. Brief Description of the Art

Single knit jersey fabrics are broadly used to make underwear and top-weight garments, such as T-shirts. Compared to woven structures, the knit fabric can more easily deform, or stretch, by compressing or elongating the individual knit stitches (comprised of interconnected loops) that form the knit fabric. This ability to stretch by stitch rearrangement adds to the wearing comfort of garments made from knit fabrics. Even when knit fabrics are constructed of 100% hard yarns, such as cotton, polyester, nylon, acrylics or wool, for example, there is some recovery of the knit stitches to their original dimensions after imposed forces are removed. However, this recovery by knit stitch rearrangement is generally not complete because the hard yarns, which are not elastomeric, do not provide a recovery force sufficient to completely rearrange the knit stitches. As a consequence, single knit fabrics may experience permanent deformations or 'bagging' in certain garment areas where more stretching occurs, such as at the elbows of shirt sleeves, for example.

To improve the recovery performance of circular, single knit fabrics, it is now common to co-knit a small amount of an elastomeric fiber, such as a spandex fiber, with the companion hard yarn.

Traditionally, if heat-setting is not used to "set" the spandex after the fabric is knitted and released from the constraints of the circular knitting machine, the stretched spandex in the fabric will retract to compress the fabric stitches so that the fabric is reduced in dimensions compared to what those dimensions would be if the spandex were not present.

Heat setting is not used for all varieties of weft knit elastic fabrics. In some cases a heavy knit will be desired, such as in double knits/ribs and flat sweater knits. In these cases, some stitch compression by the spandex is acceptable. In other cases, the bare spandex fiber is covered with natural or synthetic fibers in a core-spinning or spindle-covering operation, so that the recovery of the spandex and resultant stitch compression is restrained by the covering. In still other cases, bare or covered spandex is plated only on every second or third knit course, thereby limiting the total recovery forces that compress the knit stitches. In seamless knitting, a process wherein tubular knits are shaped for direct use while being knitted on special machines, the fabric is not heat set because dense, stretchy fabric is intended. For circular knit, elastic fabrics of at least one of single jersey, French terry, and fleece made for cutting and sewing, however, wherein bare spandex is plated in every course, heat setting is almost always required.

Heat setting has several disadvantages. Heat setting is an extra cost to finish knit elastic fabrics that contain spandex, versus fabrics that are not elastic (rigid fabrics). Moreover, high spandex heat setting temperatures can adversely affect sensitive companion hard yarns, e.g., yellowing of cotton, thereby requiring more aggressive subsequent finishing operations, such as bleaching. Aggressive bleaching can negatively affect fabric tactile properties, for example, the "hand" of the fabric, and usually requires the manufacturer to include fabric softener to counteract bleaching. Furthermore, certain fibers cannot withstand high temperature heat treatment. Heat-sensitive hard yarns, such as those from polyacryonitrile, wool and acetate, cannot be used in high temperature spandex heat setting steps, because the high heat setting temperatures will adversely affect such heat-sensitive yarns. Finally, other fibers are sensitive to heat due to low fiber melting point. Polypropylene, for example, has a softening point of 155° C., which renders it unsuitable for fabric processing which requires heat setting.

The disadvantages of heat setting have long been recognized, and, as a result, spandex compositions that heat-set at somewhat lower temperatures have been identified (U.S. Pat. Nos. 5,948,875 and 6,472,494, both of which are hereby expressly incorporated herein by reference in their entirety). For example, the spandex defined in U.S. Pat. No. 6,472,494 has a heat set efficiency greater than or equal to 85% at approximately 175-190° C. The heat set efficiency value of 85% is considered a minimum value for effective heat setting. It is measured by laboratory tests comparing the length of stretched spandex before and after heat setting to the before-stretched spandex length. While such lower heat setting spandex compositions provide an improvement, heat setting is still required, and the costs associated with it have not been significantly reduced.

The traditional practice of making and heat setting circular knit fabrics has further disadvantages. The knit fabric emerges from a circular knitting machine in the form of a continuous tube. As the tube is formed in knitting, it is either rolled under tension onto a mandrel, or it is collected as a flat tube under the knitting machine by plaiting, or loose folding. In either case, the fabric establishes two permanent creases where the fabric tube has been folded or flattened. Although the fabric is "opened" by slitting the fabric tube along one of the creases, subsequent use and cutting of the fabric usually must avoid the remaining crease. This reduces the fabric yield (or the amount of knit fabric that can be further processed into garments).

In view of the foregoing disadvantages, methods are needed for making circular knit, elastic fabrics of at least one of single jersey, French terry, and fleece that have bare elastomeric material plated with spun and/or continuous filament hard yarns, and that avoid the costs and disadvantages associated with the prior art dry heat setting methods. Additionally, the invention allows circular knit, elastic fabrics of at least one of single jersey, French terry, and fleece to be formed (stabilized, dyed, and finished) as a tube, which has material usage advantages over the prior art. French terry, and fleece to be formed (stabilized, dyed, and finished) as a tube, which has material usage advantages over the prior art.

SUMMARY OF THE INVENTION

The invention provides circular knit, elastic fabrics of at least one of single jersey, French terry, and fleece that include bare elastomeric material plated with spun and/or continuous filament hard yarns, wherein the circular knit, elastic fabrics of at least one of single jersey, French terry, and fleece can be manufactured with commercially acceptable properties without a need for in-fabric elastomeric fiber dry heat setting because: (1) the elastomeric fiber draft can be limited during the knitting process; (2) certain desired single knit fabric parameters can be maintained; and (3) the circular knit, elastic fabric of at least one of single jersey, French terry, and fleece may be contacted with a continuous phase aqueous solution under conditions of temperature and pressure for a period of time sufficient to substantially set the bare elastomeric material.

The first aspect of the invention includes a method for making circular knit, single jersey elastic fabrics in which bare elastomeric material, such as a bare spandex yarn, from 15 to 156 dtex, for example from 17 to 78 dtex, may be plated with at least one hard yarn of spun and/or continuous filament yarn, or blends thereof, with yarn count (Nm) from 10 to 165, for example from 44 to 68. The invention also includes a method for making circular knit, elastic fabrics of at least one of French terry and fleece in which bare elastomeric material, such as a bare spandex yarn, from 15 to 156 dtex, for example from 22 to 78 dtex, may be plated with at least two hard yarns of spun and/or continuous filament yarn, or blends thereof, with yarn count (Nm) from 10 to 165, for example from 34 to 68. In the circular knit, elastic fabrics of at least one of French terry and fleece, the at least two hard yarns may be different. In the circular knit, elastic fabrics of at least one of French terry and fleece, the at least two hard yarns may be the same.

The elastomeric material and the hard yarn can be plated to produce a knit fabric such as circular, flat, tricot, double jersey, ribs, fleece, and interlocks. The circular knit, elastic fabrics of at least one of single jersey, French terry, and fleece produced by this knitting method can have a cover factor of from 1.05 to 1.9. During the knitting, the draft on the elastomeric material feed can be controlled so that the elastomeric material may be drafted no more than about 7×, typically no more than 5×, for example no more than 3× its original length when knit to form the circular knit, elastic fabrics of at least one of single jersey, French terry, and fleece.

The method further includes a stabilization step which includes applying a hot, hydro-setting treatment to the circular knit, elastic fabrics of at least one of single jersey, French terry, and fleece and at a temperature and for a period of time sufficient to allow the elastomeric material in the circular knit, elastic fabric of at least one of single jersey, French terry, and fleece to undergo a change and become substantially "set". For example, the stabilization step may include hydro-setting circular knit, elastic fabrics of at least one of single jersey, French terry, and fleece in a jet dryer to a temperature ranging from about 105° C. to about 145° C. and for a residence time ranging from about 5 minutes to about 90 minutes. The stabilization step re-deniers the spandex to reduce the fabric load and unload power and fabric basis weight. Because of the stabilization step, the circular knit, elastic fabrics of at least one of single jersey, French terry, and fleece may not have to undergo a dry heat setting step, such as heating the circular knit, elastic fabrics of at least one of single jersey, French terry, and fleece on a tenter frame under tension above about 160° C. in air having a relative humidity of less than about 50%.

Next, the circular knit, elastic fabrics of at least one of single jersey, French terry, and fleece may be dyed, finished and/or dried at temperatures below the heat setting temperature of the spandex without dry heat setting the circular knit, elastic fabric of at least one of single jersey, French terry, and fleece or the spandex within the circular knit, elastic fabric of at least one of single jersey, French terry, and fleece. Finishing may comprise one or more steps, such as cleaning, bleaching, dyeing, drying, napping, brushing, and, compacting, and any combination of such steps. Typically, the finishing and drying are carried out at one or more temperatures below 160° C. Drying or compacting is carried out while the circular knit, elastic fabrics of at least one of single jersey, French terry, and fleece is in an overfeed condition in the warp direction.

The resulting circular knit, elastic fabrics of at least one of single jersey, French terry, and fleece may have an elastomeric material content of from about 3.5% to about 30% by weight based on the total fabric weight per square meter, typically from about 3.5% to about 27%, for example from about 5% to about 25% by weight based on the total fabric weight per square meter. In addition, circular knit, elastic fabrics of at least one of single jersey, French terry, and fleece may have a cover factor of from about 1.05 to about 1.9, for example, from about 1.29 to about 1.4.

The second and third aspects of the invention are the circular knit, elastic fabrics of at least one of single jersey, French terry, and fleece made according to the inventive method, and garments constructed from such fabrics. The circular knit, elastic fabrics of at least one of single jersey, French terry, and fleece produced by the inventive method can be formed with synthetic filament, spun staple yarn of natural fibers, natural fibers blended with synthetic fibers or yarns, spun staple yarn of cotton, cotton blended with synthetic fibers or yarns, spun staple polypropylene, polyethylene or polyester blended with polypropylene, polyethylene or polyester fibers or yarns, and combinations thereof and can have a basis weight of from about 100 to about 500 g/m$^2$, for example of from about 140 to about 350 g/m$^2$. The circular knit, elastic fabrics of at least one of single jersey, French terry, and fleece also can have an elongation of about 45% to about 175%, for example from about 60% to about 175% in the length (warp) direction, and a shrinkage after washing and drying of about 15% or less, typically, 14% or less, for example less than about 7% in both length and width. The circular knit, elastic fabrics of at least one of single jersey, French terry, and fleece may have been exposed to a temperature no higher than about 160° C. (such as shown by differential scanning calorimetry or molecular weight analysis of the spandex). The circular knit, elastic fabrics of at least one of single jersey, French terry, and fleece may be in the form of a tube (as output from a circular knitting process), or in the form of a flat knit. The fabric tube may be slit to provide a flat fabric. The circular knit, elastic fabric of at least one of single jersey, French terry, and fleece typically has a curling value of about 1.0 or less, for example about 0.5 or less face curl.

Garments made from the elastic fabrics of at least one of single jersey, French terry, and fleece may include swimwear, underwear, t-shirts, and top or bottom-weight garments, such as for ready-to-wear, athletic, or outdoor wear.

The present invention includes a circular knit, elastic fabric of at least one of single jersey, French terry, and fleece having at least one elastomeric material incorporated therein, wherein the at least one elastomeric material can be drafted no more than about 7×, typically no more than 5×, for example no more than 3× its original length, and the circular knit, elastic fabric of at least one of single jersey, French terry, and fleece can be exposed to a hydro-setting step prior to or during a dyeing procedure.

The present invention further includes a method for producing a circular knit, elastic fabric of at least one of single jersey, French terry, and fleece having at least one elastomeric material incorporated therein, wherein the method involves drafting the at least one elastomeric material no more than about 7× its original length, and wherein the method includes a hydro-setting step and may not include a dry heat setting step. Fabrics of the present invention may have less than about 50% of the bare spandex contact points fused, typically less than about 30%, for example less than about 10% of the bare spandex contact points fused.

The present invention further includes a circular knit, elastic fabric of at least one of single jersey, French terry, and fleece having at least one elastomeric material incorporated therein, wherein the circular knit, elastic fabrics of at least one of single jersey, French terry, and fleece can be produced in the form of a tube and can exhibit a wash shrinkage of less than about 15%, typically, 14% or less, for example 7% or less. The knit fabric tube can have no side creases formed therein, and the circular knit, elastic fabric of at least one of single jersey, French terry, and fleece can be used for cutting and sewing such fabric into garments.

The present invention further includes a circular knit, elastic fabric of at least one of single jersey, French terry, and fleece formed of a heat sensitive hard yarn and at least one elastomeric material incorporated therein.

Other features and advantages of the present invention will become apparent from the following detailed description when read in conjunction with the accompanying drawings and appended claims.

DETAILED DESCRIPTION OF THE INVENTION

Figure 1:
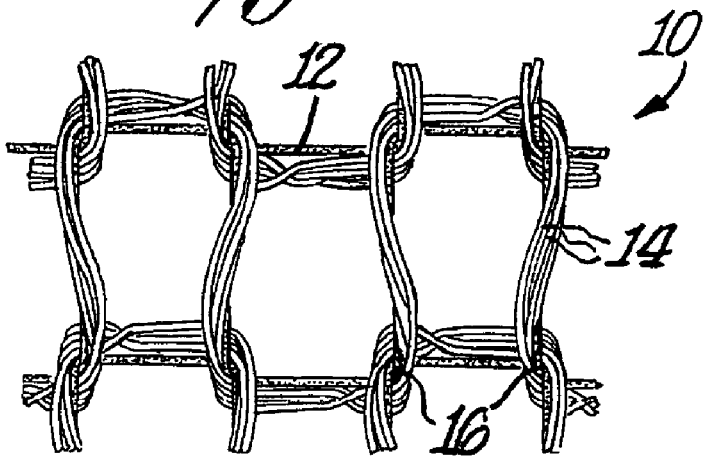
FIG. 1 is a schematic diagram of plated knit stitches comprising a hard yarn and spandex.

Before explaining at least one embodiment of the invention in detail by way of exemplary drawings, experimentation, results, and laboratory procedures, it is to be understood that the invention is not limited in its application to the details of construction and the arrangement of the components set forth in the following description or illustrated in the drawings, experimentation and/or results. The invention is capable of other embodiments or of being practiced or carried out in various ways. As such, the language used herein is intended to be given the broadest possible scope and meaning; and the embodiments are meant to be exemplary—not exhaustive. Also, it is to be understood that the phraseology and terminology employed herein is for the purpose of description and should not be regarded as limiting.

The term "elastomeric material" or "elastomer" as used herein will be understood to refer to a synthetic material that has the excellent stretchability and recovery of natural rubber such that the material is capable of repeated stretching to at least twice its original length, as well as immediate and forcible recovery to its approximate original length upon release of stress. The "elastomeric material" is generally a manufactured fiber in which the fiber forming substance is a long chain synthetic polymer having segmented polyurethane. Examples of elastomeric materials that may be utilized in accordance with the present invention include, but are not limited to, spandex, elastane, anidex, elastoester, bi-constituent filament rubber, and combinations thereof.

As used herein, "spandex" means a manufactured fiber in which the fiber-forming substance is a long-chain synthetic polymer comprised of at least 85% of a segmented polyurethane. The polyurethane is prepared from a polyether glycol, a mixture of diisocyanates, and a chain extender and then melt-spun, dry-spun or wet-spun to form the spandex fiber. The spandex preferably is a commercially available elastane product for circular knitting, such as Lycra® types T162B, T162C, T165C, T169B and T562.

The term "denier" as used herein will be understood to be a relative measure of a linear density (or fineness) of a fiber or yarn. Denier is equivalent numerically to the weight in grams per 9,000 meters length of the material. The term "decitex" as used herein will be understood to be equivalent to the weight in grams of a 10,000 meter length of the material.

The term "draft" as used herein refers to the amount of stretch applied to a strand of elastomeric material, such as spandex, resulting in a reduction in linear density of the strand of elastomeric material. The draft of a fiber is directly related to the elongation (stretching) applied to the fiber. For example, 100% elongation corresponds to 2× draft, and 200% elongation corresponds to 3× draft, etc.

The term "hard yarns" as used herein will be understood to refer to knitting yarns which do not contain a high amount of elastic stretch, such as natural and/or synthetic spun staple yarns, natural and/or synthetic continuous filament yarns, and combinations thereof. Examples of materials that may be utilized in the spun staple and/or continuous filament hard yarns in accordance with the present invention include, but are not limited to, cotton, polyester, nylon, polypropylene, polyethylene, acrylics, wool, acetate, polyacryonitrile, and combinations thereof. Natural fibers as used herein will be understood to refer to fibers such as cellulosic (i.e. cotton, bamboo) or protein (i.e. wool, silk, soybean) fibers.

The term "hard yarn count" as used herein will be understood to refer to a measure of the fineness or linear density of a yarn. Hard Yarn Count may be expressed in indirect units (length per unit of weight or mass) or direct units (weight per unit of length). In one embodiment, hard yarn count is represented as "Ne" in the English system of measurement and as "Nm" in the Metric system of measurement.

As used herein, the term "warp direction" refers to the length direction of the fabric, and the term "weft direction" refers to the width direction of the fabric.

The term "Cover Factor" as used herein will be understood to refer to the ratio of fabric surface occupied by yarns to total fabric surface. The Cover Factor is a relative measure of the openness of each knit stitch that characterizes the structural design of a circular knit fabric. This "openness" is related to the percentage of the area that is open versus that which is covered by the yarn in each stitch. The calculation of the Cover Factor is described in further detail herein below.

The term "dry heat setting" as used herein will be understood to refer to a step involving positioning of a fabric on a tenter frame under tension and exposing the fabric to temperatures above about 160° C., and generally in a range of from about 175° C. to about 200° C., in air having a relative humidity of less than about 50%, for a sufficient amount of time to stabilize the spandex at a lower denier. In dry heat setting, the spandex permanently changes at a molecular level so that recovery tension in the stretched spandex is mostly relieved and the spandex becomes stable at a new and lower denier.

The term "hydro-setting" as used herein will be understood to refer to a step in the presently claimed and disclosed invention, in which the knitted fabric is treated with hot water (for example, having a temperature of about 105° C. or higher), at very low tension and for a period of time sufficient to allow the elastomeric material in the fabric to undergo a change and become at least in part stabilized.

The term "fusing" as used herein will be understood to refer to the melting together of bare spandex yarns at contact points in the fabric. Fabrics of the present invention may have less than about 50% of the bare spandex contact points fused, for example, less than about 30%, about 10%, or about 5% of the bare spandex contact points fused.

As used herein, the terms "molecular weight analysis" and "differential scanning calorimetry" refer to methods for determining the highest temperature at which a sample of spandex has been exposed. The term "molecular weight analysis" refers to a method of analyzing the molecular weight of an elastomeric material and correlating that to the thermal history of the elastomeric material. The term "differential scanning calorimetry" refers to a measurement of the amount of energy (heat) absorbed or released by a sample as it is heated, cooled, or held at a constant temperature.

For knit constructions in circular knit machines, the process of co-knitting spandex is called "plating." With plating, the hard yarn and the bare spandex yarn are knitted in parallel, side-by-side relation, with the spandex yarn always kept on one side of the hard yarn, and hence on one side of the knitted fabric. FIG. 1 is a schematic illustration of plated knit stitches 10 wherein the knitted yarn comprises spandex 12 and a multi-filament hard yarn 14. When spandex is plated with hard yarn to form a knit fabric, additional processing costs are incurred beyond the added cost of the spandex fiber. For example, fabric stretching and heat setting usually are required in the finishing steps when making circular knit, elastic fabric of at least one of single jersey, French terry, and fleece.

By "circular knitting" is meant a form of weft knitting in which the knitting needles are organized into a circular knitting bed. Generally, a cylinder rotates and interacts with a cam to move the needles reciprocally for knitting action. The yarns to be knitted are fed from packages to a carrier plate that directs the yarn strands to the needles. The circular knit fabric emerges from the knitting needles in a tubular form through the center of the cylinder.

Figure 4:
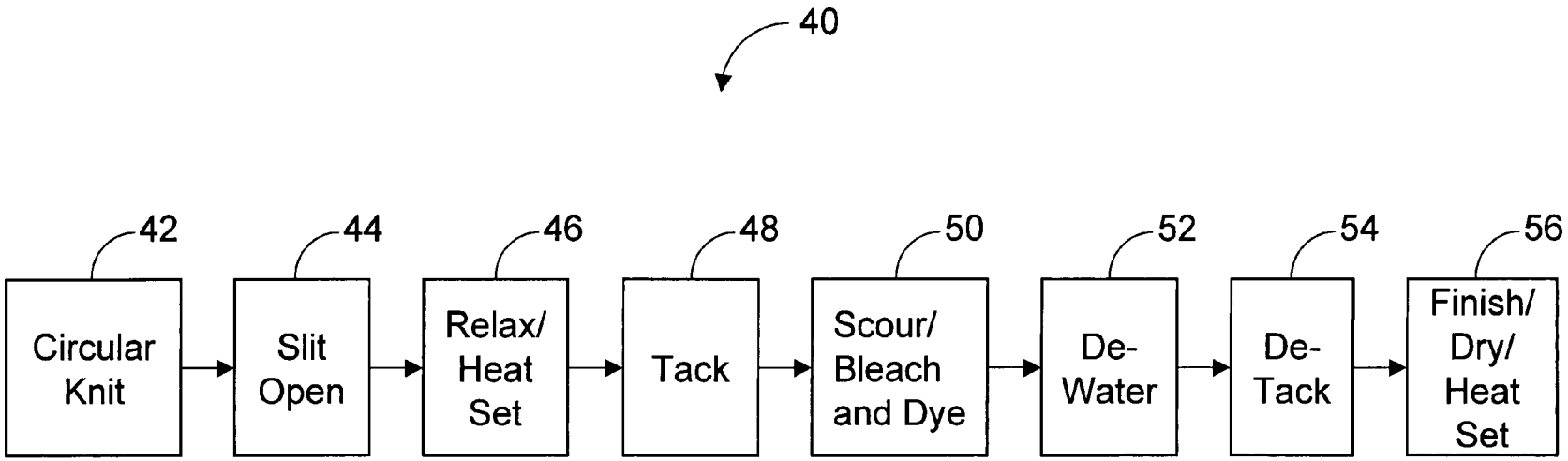
FIG. 4 is a flow chart showing prior art process steps for making circular knit, elastic, single jersey fabrics that have bare spandex plated in every knit course.

The steps for making elastic circular knit fabrics according to one known process 40 are outlined in FIG. 4. Although process variations exist for different fabric knit constructions and fabric end uses, the steps shown in FIG. 4 are representative for making single jersey knit elastic fabrics with spun hard yarns, such as but not limited to, cotton. The fabric is first circular knit 42 at conditions of high spandex draft and feed tensions. For example, for single jersey, fabrics made with bare spandex plated in every knit course, the known feed tension range is 2 to 4 cN for 22 dtex spandex; 3 to 5 cN for 33 dtex; and 4 to 6 cN for 44 dtex (DuPont Technical Bulletin L410). The fabric is knit in the form of a tube, which is collected under the knitting machine either on a rotating mandrel as a flattened tube, or in a box after it is loosely folded back and forth (i.e., "plaited").

In open-width finishing, the knitted tube is then slit open 44 and laid flat. The open fabric is subsequently relaxed 46, either by subjecting it to steam, or by wetting it by dipping and squeezing (padding). The relaxed fabric is then applied to a tenter frame and heated (for heat setting 46) in an oven. The tenter frame holds the fabric on the edges by pins, and stretches it in both the length and width directions in order to return the fabric to desired dimensions and basis weight. This heat setting is accomplished before subsequent wet processing steps and, consequently, heat setting is often referred to as "pre-setting" in the trade. At the oven exit, the flat fabric is released from the stretcher and then tacked 48 (sewed) back into a tubular shape. The fabric then is processed in tubular form through wet processes 50 of cleaning (scouring) and optional bleaching/dyeing, e.g., by soft-flow jet equipment, and then dewatered 52, e.g., by squeeze rolls or in a centrifuge. The fabric is then "de-tacked" 54 by removing the sewing thread and re-opening the fabric into a flat sheet. The flat, still wet, fabric is then dried/heat set 56 in a tenter-frame oven under conditions of fabric overfeed (opposite of stretching) so that the fabric is under no tension in the length (machine) direction while being dried at temperatures below heat-setting temperatures. The fabric is slightly tensioned in the width direction in order to flatten any potential wrinkling. An optional fabric finish, such as a softener, may be applied just prior to the drying/heatsetting operation 56. In some cases, a fabric finish is applied after the fabric is first dried by a belt or tenter-frame oven, so that the finish is taken up uniformly by fibers that are equally dry. This extra step involves re-wetting the dried fabric with a finish, and then drying the fabric again in a tenter-frame oven.

Heat setting of dry fabric in a tenter frame or other drying apparatus "sets" spandex in an elongated form. This is also known as redeniering, wherein a spandex of higher denier is drafted, or stretched, to a lower denier, and then heated to a sufficiently high temperature, for a sufficient time, to stabilize the spandex at the lower denier. Heat setting therefore means that the spandex permanently changes at a molecular level so that recovery tension in the stretched spandex is mostly relieved and the spandex becomes stable at a new and lower denier. Heat setting temperatures for spandex are generally in the range of about 175° C. to about 200° C. For the widely known prior art process 40 shown in FIG. 4, the heat setting 46 commonly is for about 45 seconds or more at about 190° C.

Compression of the stitches in the knitted fabric has three major effects that are directly related to elastic knit fabric properties, and thereby usually renders the fabric inappropriate for subsequent cut and sew operations.

First, stitch compression reduces fabric dimensions and increases fabric basis weight (g/m$^2$) beyond desired ranges for circular knit, elastic fabric of at least one of single jersey, French terry, and fleece for use in garments. As a result, the traditional finishing process for elastic circular knit fabric includes a fabric stretching and heating step, which occurs at sufficiently high temperatures and sufficiently long residence time, so that the spandex yarn in the knit will "set" at desired stretched dimensions. After heat setting, the spandex yarn will either not retract, or will retract only modestly below its heat-set dimension. Thus, the heat-set spandex yarn will not significantly compress the knit stitches from the heat-set dimensions. Stretching and heat setting parameters are chosen to yield the desired fabric basis weight and elongation, within relatively tight limits. For a typical cotton-jersey elastic single knit, the desired elongation is at least 60%, and the basis weight ranges from about 140 to about 500 g/m$^2$.

Second, the more severe the stitch compression, the more the fabric will elongate on a percentage basis, thus far exceeding minimum standards and practical needs. When a plated knit with elastic yarn is compared with a fabric knit without elastic yarn, it is common for the plated elastic knit fabric to be 50% shorter (more compressed) than the fabric without elastic yarn. The plated knit is able to stretch in length 150% or more from this compressed state, and such excessive elongation is generally undesirable in jersey knits for cut and sew applications. This length is in the warp direction of the fabric. Fabrics with high elongation in length (stretch) are more likely to be cut irregularly, and are also more likely to shrink excessively upon washing. Similarly, stitches are compressed by spandex in the width direction, so that fabric width is reduced about 50% as well, far beyond the 15 to 20% as-knit width reduction normally encountered with rigid (non-elastic) fabrics.

Third, the compressed stitches in the finished fabric are at an equilibrium condition between spandex recovery forces and resistance to stitch compression by the companion hard yarn. Washing and drying of the fabric can reduce the hard-yarn resistance, probably in part because of agitation of the fabric. Thus, washing and drying may permit the spandex recovery forces to further compress the knit stitches, which can result in unacceptable levels of fabric shrinkage. Heat-setting the knit fabric serves to relax the spandex and reduce the spandex recovery force. The heat setting operation therefore improves the stability of the fabric, and reduces the amount that the fabric will shrink after repeated washings.

The subject of the presently disclosed and claimed invention is circular knitting and, in particular, the manufacture of circular knit, elastic fabric of at least one of single jersey, French terry, and fleece for subsequent 'cut and sew' use. These knit elastic fabrics are formed of an elastomeric material and a hard yarn, wherein the elastomeric material is drafted no more than about 7× and the knit elastic fabric is subjected to a hydro-setting step and is not dry heat set. The resulting fabric may have superior performance relative to known fabrics in terms of achieving fabric basis weight of about 100 g/m$^2$ to about 400 g/m$^2$ with reduced fabric shrinkage and acceptable fabric elongation. Additionally, an improvement in fabric curling is found when hydro-setting is applied to fabrics with a final weight of from about 100 g/m$^2$ to about 400 g/m$^2$.

The presently disclosed and claimed invention also relates to a process for making circular knit, elastic fabric of at least one of single jersey, French terry, and fleece comprising spandex and polypropylene hard yarns without requiring dry heat setting. Since polypropylene fibers cannot be heatset at temperatures required to permanently deform the spandex, the present invention represents a novel method of fabricating spandex-polypropylene knit fabrics. The resulting fabric has superior performance relative to known fabrics in terms of achieving fabric basis weight of about 140 g/m$^2$ to about 400 g/m$^2$ with reduced fabric shrinkage and acceptable fabric elongation. Additionally, an improvement in fabric curling is found when hydro-setting is applied to fabrics with a final weight of 150 to 400 g/m$^2$.

Figure 2:
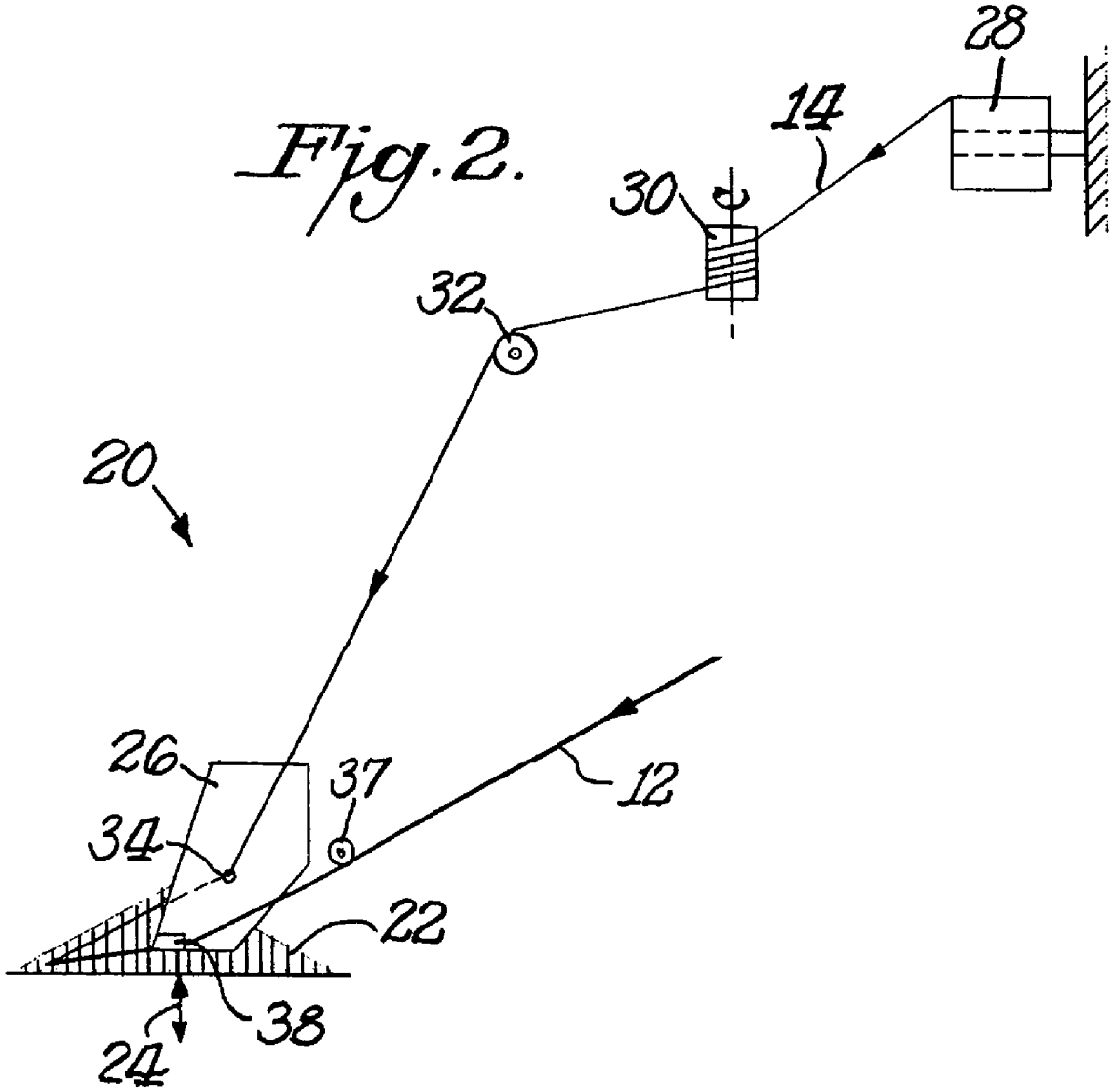
FIG. 2 is a schematic diagram of a portion of a circular knitting machine fed with a spandex feed and a hard yarn feed.

Regarding circular knitting, FIG. 2 shows in schematic form one feed position 20 of a circular knitting machine having a series of knitting needles 22 that move reciprocally as indicated by the arrow 24 in response to a cam (not shown) below a rotating cylinder (not shown) that holds the needles. In a circular knitting machine, there are multiple numbers of these feed positions arranged in a circle, so as to feed individual knitting positions as the knitting needles, carried by the moving cylinder, are rotated past the positions.

For plating knit operations, a spandex yarn 12 and a hard yarn 14 are delivered to the knitting needles 22 by a carrier plate 26. The carrier plate 26 simultaneously directs both yarns to the knitting position. The spandex yarn 12 and hard yarn 14 are introduced to the knitting needles 22 at the same or at a similar rate to form a single jersey knit stitch 10 like that shown in FIG. 1.

While the Figures may be described herein in conjunction with the use of spandex yarn, it is to be understood that the use of spandex yarn in the following description is for exemplary purposes only, and thus the present invention is not limited to the use of spandex. Rather, any elastomeric material may be substituted for spandex in the present invention and fall within the scope of the present invention. While the use of another elastomeric material may require parameters that fall outside the ranges described herein, it is to be understood that a person of ordinary skill in the art could easily ascertain the required parameters for the substitute elastomeric material given the teachings and disclosure of the present specification, and therefore such parameters fall well within the scope and teachings of the presently claimed and disclosed invention.

The hard yarn 14 is delivered from a wound yarn package 28 to an accumulator 30 that meters the yarn to the carrier plate 26 and knitting needles 22. The hard yarn 14 passes over a feed roll 32 and through a guide hole 34 in the carrier plate 26. Optionally, more than one hard yarn may be delivered to the knitting needles via different guide holes in the carrier plate 26. For French terry fabric construction of the claimed invention, two hard yarns are knitted with one elastomeric yarn. One hard yarn is plated with the elastomeric yarn as in FIG. 2 and a second hard yarn is laid into the fabric. As such, the plated jersey and the terry yarn are feeding into the machine alternately. Fleece fabric is made from French terry fabric that has undergone a napping finishing step. The formation of a French terry and fleece fabrics are well known to those skilled in the art.

The spandex 12 is delivered from a surface driven package 36 and past a broken end detector 39 and change of direction roll(s) 37 to a guide slot 38 within the carrier plate 26. The feed tension of the spandex 12 is measured between the detector 39 and drive roll 37, or alternatively between the surface driven package 36 and roll 37 if the broken end detector is not used. The guide hole 34 and guide slot 38 are separated from one another in the carrier plate 26 so as to present the hard yarn 14 and spandex 12 to the knitting needles 22 in side by side, generally parallel relation (plated).

The spandex stretches (drafts) when it is delivered from the supply package to the carrier plate and in turn to the knit stitch due to the difference between the stitch use rate and the feed rate from the spandex supply package. The ratio of the hard yarn supply rate (meters/min) to the spandex supply rate is normally from about 2.5 to about 4 times greater, and is known as the machine draft. This corresponds to spandex elongation of from about 150% to about 300%, or more. The feed tension in the spandex yarn is directly related to the draft (elongation) of the spandex yarn. This feed tension is typically maintained at values consistent with high machine drafts for the spandex.

The present invention has identified that improved results are obtained over the prior art when the total spandex draft, as measured in the fabric, is kept to about 7× or less, typically 3× or less, for example 2.5× or less. This draft value is the total draft of the spandex, which includes any drafting or drawing of the spandex that is included in the supply package of as-spun yarn. The value of residual draft from spinning is termed package relaxation, "PR", and it typically ranges from about 0.05 to about 0.15 for the spandex used in circular knit, elastic fabrics of at least one of single jersey, French terry, and fleece. The total draft of the spandex in the fabric is therefore MD*(1+PR), where "MD" is the knitting machine draft. The knitting machine draft is the ratio of hard yarn feed rate to spandex feed rate, both from their respective supply packages.

Because of its stress-strain properties, spandex yarn drafts (draws) more as the tension applied to the spandex increases; conversely, the more that the spandex is drafted, the higher the tension in the yarn. A typical spandex yarn path, in a circular knitting machine, is schematically shown in FIG. 2. The spandex yarn 12 is metered from the supply package 36, over or through a broken end detector 39, over one or more change-of-direction rolls 37, and then to the carrier plate 26, which guides the spandex yarn 12 to the knitting needles 22 and into the stitch. There is a build-up of tension in the spandex yarn 12 as it passes from the supply package 36 and over each device or roller, due to frictional forces imparted by each device or roller that touches the spandex yarn 12. The total draft of the spandex yarn 12 at the stitch is therefore related to the sum of the tensions throughout the spandex path.

The spandex feed tension is measured between the broken end detector 39 and the roll 37 shown in FIG. 2. Alternatively, the spandex feed tension is measured between the surface driven package 36 and roll 37 if the broken end detector 39 is not used. The higher this tension is set and controlled, the greater the spandex draft will be in the fabric, and vice versa. The prior art teaches that this feed tension should range from about 2 to about 4 cN for 22 dtex spandex, and from about 4 to about 6 cN for 44 dtex spandex in commercial circular knitting machines. With these feed tension settings and the additional tensions imposed by subsequent yarn-path friction, the spandex (44 dtex for example) in commercial knitting machines will be drafted significantly more than about 3× for example.

The presently disclosed and claimed invention does not anticipate all the ways that spandex friction can be minimized between the supply package and the knit stitch. The method requires, however, that friction be minimized in order to keep the spandex feed tensions sufficiently high for reliable spandex feeding while at the same time maintaining the spandex draft to about 7× or less, typically, 3× or less, for example, about 2.5× or less.

Figure 6:
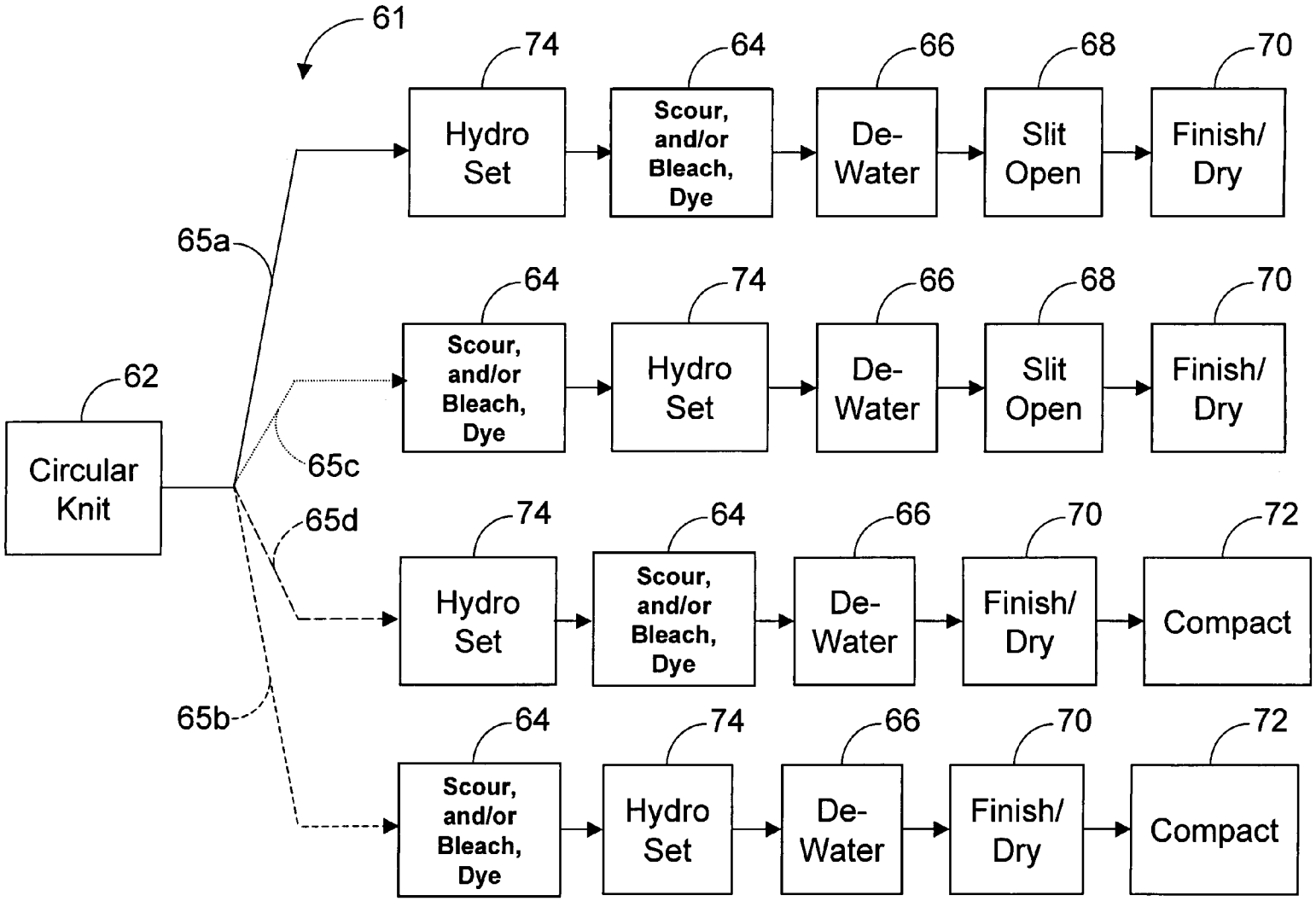
FIG. 6 is a flow chart showing the inventive process steps for making circular knit, elastic, single jersey fabrics that have bare spandex plated in every knit course in one embodiment of the present invention.
Figure 7:
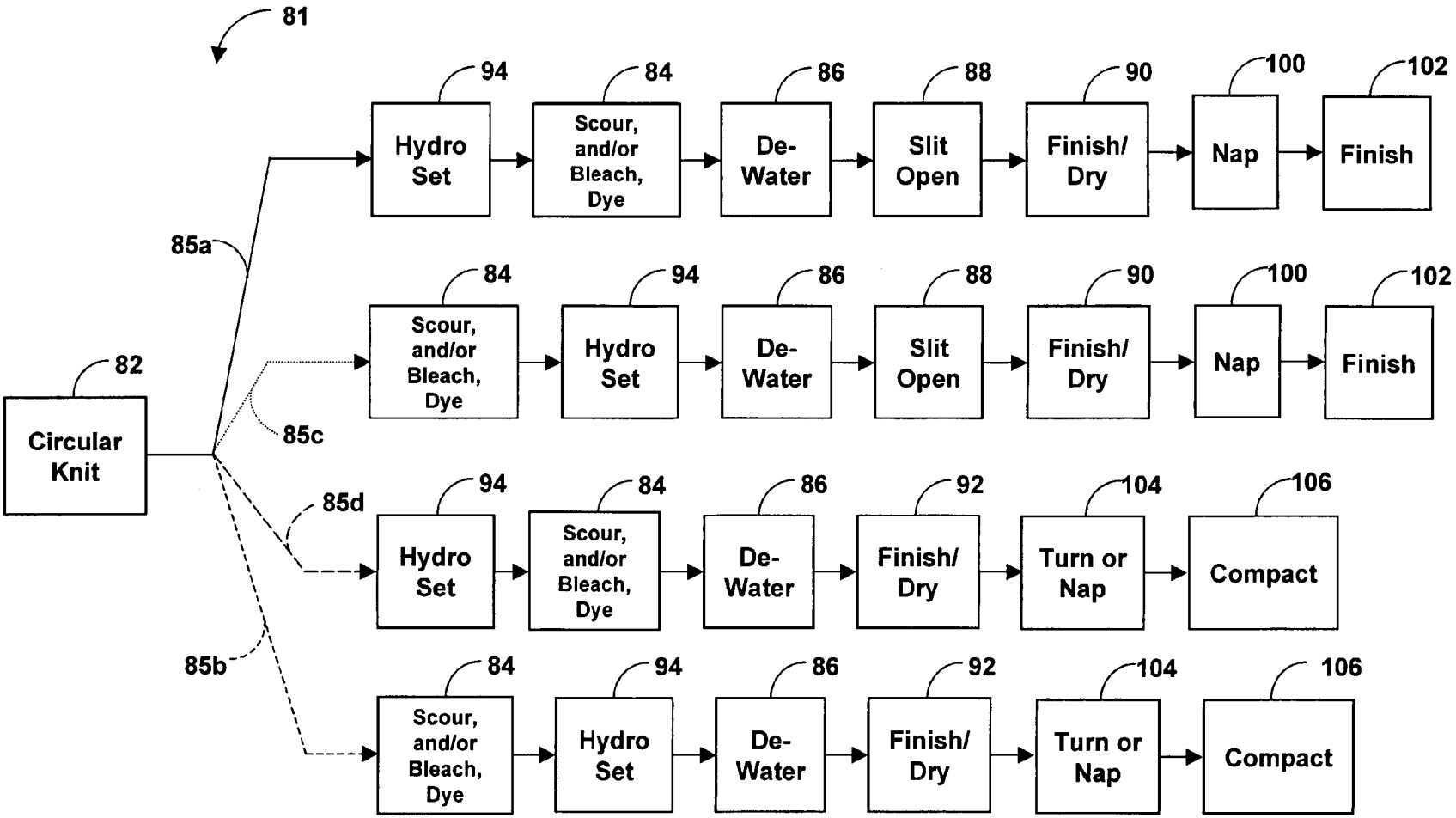
FIG. 7 is a flow chart showing the inventive process steps for making circular knit, elastic, French terry and fleece fabrics that have bare spandex plated in alternate knit courses in one embodiment of the present invention.

After knitting a circular knit, elastic fabric of at least one of single jersey, French terry, and fleece of plated spandex with hard yarn per the method of the presently disclosed and claimed invention, such fabric is finished in any of the alternate processes illustrated diagrammatically in FIGS. 6 and 7.

A second aspect of the present invention is a hot water setting treatment 74 (or 94), which can be carried out immediately before or after the scouring and bleaching step 64 (or 84) (respectively, FIGS. 6 and 7). The fabric is treated with hot water in a jet dryer for a period of from about 5 to about 90 minutes at a water temperature of from about 105° C. to about 145° C. and at a pressure not over about 4.0 kg/cm$^2$. During said hydro-setting, the fabric may be run through the jet as if it was being dyed, but without adding dye. Alternatively, the hydro-setting step may include contacting the fabric with aqueous dye solution. In a jet dyer, a loop of tubular knit fabric is moved in and out of the liquid bath by action of a venturi jet that uses the bath liquid (or alternatively air) to forward the fabric. During this hydro-setting process 74 (or 94), the spandex fiber within the fabric is exposed to wet thermal conditions such that properties of the spandex change. The denier of the fiber and the elastic strength of the fiber decrease. The load power of the spandex after hydro-setting decreases by about 40% while the unload force is decreased by about 20% relative to a non-hydro set fiber. Fabric is then dyed or scoured in the same jet dryer, paths 65*a* or 65*d* in FIG. 6 (paths 85*a* or 85*d* in FIG. 7). Alternately, the fabric may be dyed prior to the hydroset step, paths 65*b* or 65*c* in FIG. 6 (85*b* or 85*c* in FIG. 7). If a hydro-setting step is not used as in paths 63*a* and 63*b* of FIG. 5, then the basis weight for the finished fabrics would be higher, as shown in the Examples.

Drying operations 70 can be carried out on circular knit, elastic, single jersey fabric in the form of an open width web (top two rows of diagram, paths 65*a* and 65*c*), or as a tube (bottom two rows of diagram, paths 65*b* and 65*d*). For either of these paths, wet finishing process steps 64 (such as scouring, bleaching and/or dyeing) are carried out on the circular knit, elastic, single jersey fabric while it is in the tubular form. One form of dyeing, called soft-flow jet dyeing, usually imparts tension and some length deformation in the circular knit, elastic, single jersey fabric. Care should be taken to minimize any additional tension applied during fabric processing and transport from wet finishing to the dryer, and also enable the circular knit, elastic, single jersey fabric to relax and recover from such wet-finishing and transport tensions during drying.

Following wet finishing process steps 64, the circular knit, elastic, single jersey fabric is dewatered 66, such as by squeezing or centrifuging. In process paths 65*a* and 65*c*, the tubular fabric is then slit open 68 before it is delivered to a finish/dry step 70 for optional finish application (e.g., softener by padding) and subsequent drying in a tenter-frame oven under conditions of fabric length overfeed. In process paths 65*b* and 65*d*, the tubular fabric is not slit open, but is sent as a tube to the finish/dry step 70. Finish, such as softener, can be optionally applied by padding. The tubular fabric is sent through a drying oven, e.g., laid on a belt, and then to a compactor to separately provide fabric overfeed. A compactor commonly uses rolls to transport the fabric, usually in a steam atmosphere. The first roll(s) is driven at a faster speed of rotation than the second roll(s) so that the fabric has an overfeed. Generally, the steam does not "re-wet" the fabric so that no additional drying is required after compacting.

The drying step 70 (paths 65*a* and 65*c*) or the compacting step 72 (paths 65*b* and 65*d*) is operated with controlled, high fabric overfeed in the length (machine) direction so that the fabric stitches are free to move and rearrange without tension. A flat, non-wrinkled or non-buckled fabric emerges after drying. These techniques are familiar to those skilled in the art. For open width fabrics, a tenter-frame is used to provide fabric overfeed during drying. For tubular fabrics, forced overfeed is typically provided in a compactor 72, after belt drying. In either open-width or tubular fabric processing, the fabric drying temperature and residence time are set below the values required to heat set the spandex.

French terry and fleece fabrics are knit, wet finished, and hydro-set similarly to single jersey fabrics, FIG. 7. For open-width finishing, tubular fabrics are slit open 88. In the finish/drying step 90 a nap assist is padded onto the fabric. The drying is followed by a napping step 100 and a final finishing pass through a tenter frame 102 for open width fleece fabrics. For open-width French terry finished fabrics, the napping 100 and final finishing 102 steps are not required. For tubular finished fabrics, the tubular fabric is not slit open, but is sent as a tube to the finish/dry step 92. The tubular fabric is sent through a drying oven, e.g., laid on a belt. For tubular fleece fabrics, drying is followed by a napping step 104 and a final compacting step 106. For French terry fabrics, the tube of fabric is turned inside out 104 and compacted 106.

The drying step 90 (or 92) or the compacting step 106 (or finishing step 102) is operated with controlled, high fabric overfeed in the length (machine) direction so that the fabric stitches are free to move and rearrange without tension. A flat, non-wrinkled or non-buckled fabric emerges after drying. These techniques are familiar to those skilled in the art. For open width fabrics, a tenter-frame is used to provide fabric overfeed during drying. For tubular fabrics, forced overfeed is typically provided in a compactor 106, after turning or napping. In either open-width or tubular fabric processing, the fabric drying temperature and residence time are set below the values required to heat set the spandex.

Figure 3:
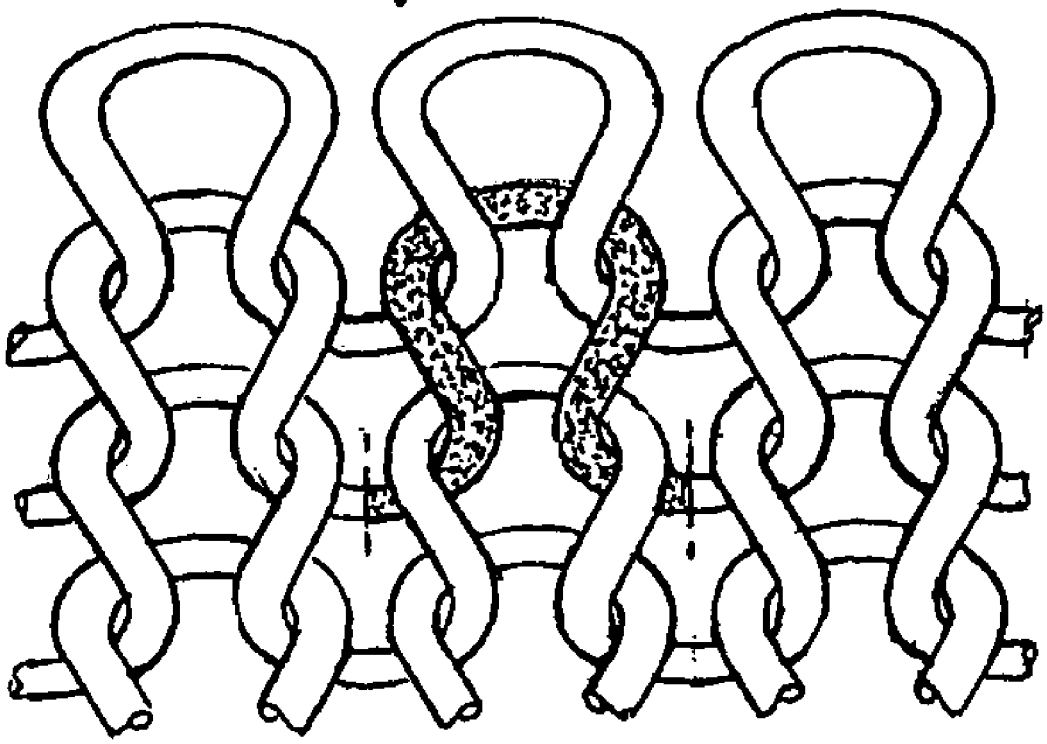
FIG. 3 is a schematic diagram illustrating a series of single jersey knit stitches and highlighting one stitch of stitch length "L".

The structural design of a circular knit, elastic fabrics of at least one of single jersey, French terry, and fleece can be characterized in part by the "openness" of each knit stitch. This "openness" is related to the percentage of the area that is open versus that which is covered by the yarn in each stitch (see, e.g., FIGS. 1 and 3), and is thus related to fabric basis weight and elongation potential. For rigid, non-elastic weft knit fabrics, the Cover Factor ("Cf") is well known as a relative measure of openness. The Cover Factor is a ratio and is defined as:

$$Cf=\sqrt{(tex)}\div L$$

where tex is the grams weight of 1000 meters of the hard yarn, and L is the stitch length in millimeters. FIG. 3 is a schematic of a single knit jersey stitch pattern. One of the stitches in the pattern has been highlighted to show how the stitch length, "L" is defined. For yarns of metric count Nm, the tex is 1000÷Nm, and the Cover Factor is alternatively expressed as follows:

$$Cf=\sqrt{(1000/\mathrm{Nm})}\div L.$$

The presently disclosed and claimed invention describes, in one embodiment, the production of commercially useful circular knit, elastic fabrics of at least one of single jersey, French terry, and fleece plated from bare elastomeric material, such as bare spandex, and a hard yarn that are produced without a dry heat setting step, by maintaining the elastomeric material draft at about 7× or less, typically, 3× or less, for example 2.5× or less, and by designing and manufacturing the knit fabric within the following guidelines:

- The Cover Factor, which characterizes the openness of the knit structure, is between about 1.05 and about 1.9, and is for example from about 1.14 to about 1.6;
- The hard yarn count, Nm, is from about 165 to about 10, for example from about 68 to about 44, typically from about 54 to 47;
- The elastomeric material has from about 15 to about 156 dtex, for example from about 22 to about 78 dtex;
- The content of elastomeric material in the circular knit, elastic, single jersey, French terry, or fleece fabric, on a % weight basis, is from about 3.5% to about 30%, and is typically from about 3.5% to about 27%, for example from about 5% to about 25%;
- The hot, hydro-setting treatment can be applied to knit fabric in a jet dyer for about 5 to about 90 minutes at temperatures of about 105° C. to about 145° C.;
- The circular knit, elastic fabrics of at least one of single jersey, French terry, and fleece so formed has a curling value of 1.0 or less;
- The circular knit, elastic fabrics of at least one of single jersey, French terry, and fleece so formed has a shrinkage after washing and drying of about 15% or less, typically 14% or less, for example 7% or less, in both the length and width directions;
- The circular knit, elastic fabrics of at least one of single jersey, French terry, and fleece has an elongation of about 35% to about 175%, for example from about 60% to about 175%, in the length (warp) direction; and
- The hard yarn is a synthetic filament (such as polypropylene or polyester), spun staple yarn of natural fibers, natural fibers blended with synthetic fibers or yarns (such as polypropylene or polyester), spun staple yarn of cotton, cotton blended with synthetic fibers or yarns, spun staple polypropylene, polyethylene or polyester blended with polypropylene, polyethylene or polyester fibers or yarns, and combinations thereof.

While not wishing to be bound by any one theory, it is believed that the hard yarn in the knit structure resists the spandex force that acts to compress the knit stitch. The effectiveness of this resistance is related to the knit structure, as defined by the Cover Factor. For a given hard yarn count, Ne, the Cover Factor is inversely proportional to the stitch length, L. This length is adjustable on the knitting machine, and is therefore a key variable for control.

Because the elastomeric material is not heat set in the process of the invention, the elastomeric material draft should be the same in circular knit, elastic fabrics of at least one of single jersey, French terry, and fleece, the finished fabric, or at fabric-processing steps in-between, within the limits of measurement error.

For circular knit, elastic fabrics of at least one of single jersey, French terry, and fleece, the appropriate gauge of knitting machine is selected according to prior art relationships between hard yarn count and knitting machine gauge. Choice of gauge can be used to optimize circular knit, elastic fabrics of at least one of single jersey, French terry, and fleece basis weight, for example.

In the circular knit, elastic fabrics of at least one of French terry and fleece, the at least two hard yarns may be different. In the circular knit, elastic fabrics of at least one of French terry and fleece, the at least two hard yarns may be the same.

The benefits of the presently disclosed and claimed invention are evident when the prior art process shown diagrammatically in FIG. 4, is compared with the inventive process shown diagrammatically in FIGS. 6 and 7. Traditional knitting and finishing require additional process steps, additional equipment, and significantly increased labor-intensive operations than do any of the alternative methods of the invention shown in FIGS. 6 and 7. Further, by eliminating high-temperature dry heat set previously required (see FIG. 4), the inventive process reduces heat damage to fibers like cotton, requires less or no bleaching, and thus improves the 'hand' of the finished fabric. As a further benefit, heat sensitive hard yarns can be used in the invention process to make circular knit, elastic fabrics of at least one of single jersey, French terry, and fleece, thus increasing the possibilities for different and improved products.

The use of a softener is optional, but commonly a softener will be applied to the circular knit, elastic fabric of at least one of single jersey, French terry, and fleece to further improve fabric hand, and to increase mobility of the knit stitches during drying. Softeners such as SURESOFT SN (Surry Chemical) or SANDOPERM SEI® (Clairant) are typical. The circular knit, elastic fabric of at least one of single jersey, French terry, and fleece may be passed through a trough containing a liquid softener composition, and then through the nip between a pair of pressure rollers (padding rollers) to squeeze excess liquid from such fabric.

Another unexpected advantage of the present invention is that the circular knit, elastic, single jersey fabrics knitted by the method of the invention and collected by folding (plaiting), do not crease to the same extent as prior art circular knit single jersey fabrics. Fewer or less visible fold creases in the finished fabric result in an increased yield for cutting and sewing the fabric into garments. Also unexpectedly, the circular knit, elastic, single jersey fabrics of the invention have significantly reduced "skew". The decrease in skew is accomplished through either open-width or tubular finishing processes. If a fabric has increased skew or spirality, the fabric is diagonally deformed and knitted courses are "on the bias". Garments made with skewed fabric will twist on the body and are unacceptable for use.

The following examples demonstrate the presently disclosed and claimed invention and its benefits. The invention is capable of other and different embodiments, and its several details are capable of modifications in various apparent respects, without departing from the scope and spirit of the presently disclosed and claimed invention. Accordingly, the examples are to be regarded as illustrative in nature and not as restrictive.

EXAMPLES

Fabric Knitting and Finishing

Circular knit, elastic fabrics of at least one of single jersey, French terry, and fleece with bare spandex plated with hard yarn for the examples were knit on either: (1) Pai Lung Circular Knitting Machine Model PL-FS3B/T, with 16 inch cylinder diameter, 28 gauge cylinder (needles per circumferential inch), and 48 yarn feed positions; (2) Pai Lung Circular Knitting Machine Model PL-XS3B/C, with 26 inch cylinder diameter, 24 gauge cylinder, and 78 yarn feed positions; or (3) Monarch Circular Knitting Machine Model VXC-3S, with 30 inch cylinder diameter, 20 gauge cylinder, and 90 yarn feed positions. The 28 and 20-gauge machines were operated at 24 revolutions per minute (rpm), and the 24-gauge machine at 26 rpm.

The broken end detector in each spandex feed path (see FIG. 2) was either adjusted to reduce sensitivity to yarn tension, or removed from the machines for these examples. The broken end detector was a type that contacted the yarn, and therefore induced tension in the spandex.

The spandex feed tension was measured between the spandex supply package 36 and the roller guide 37 (FIG. 2) with a Zivy digital tension meter, model number, EN-10. The spandex feed tensions were maintained at 1 gram or less for 20 and 30-denier spandex. These tensions were sufficiently high for reliable and continuous feeding of the spandex yarn to the knitting needles, and sufficiently low to draft the spandex only about 2× or less. It was determined that when the feed tensions were too low, the spandex yarn wrapped around the roller guides at the supply package and could not be reliably fed to the circular knitting machine.

Figure 5:
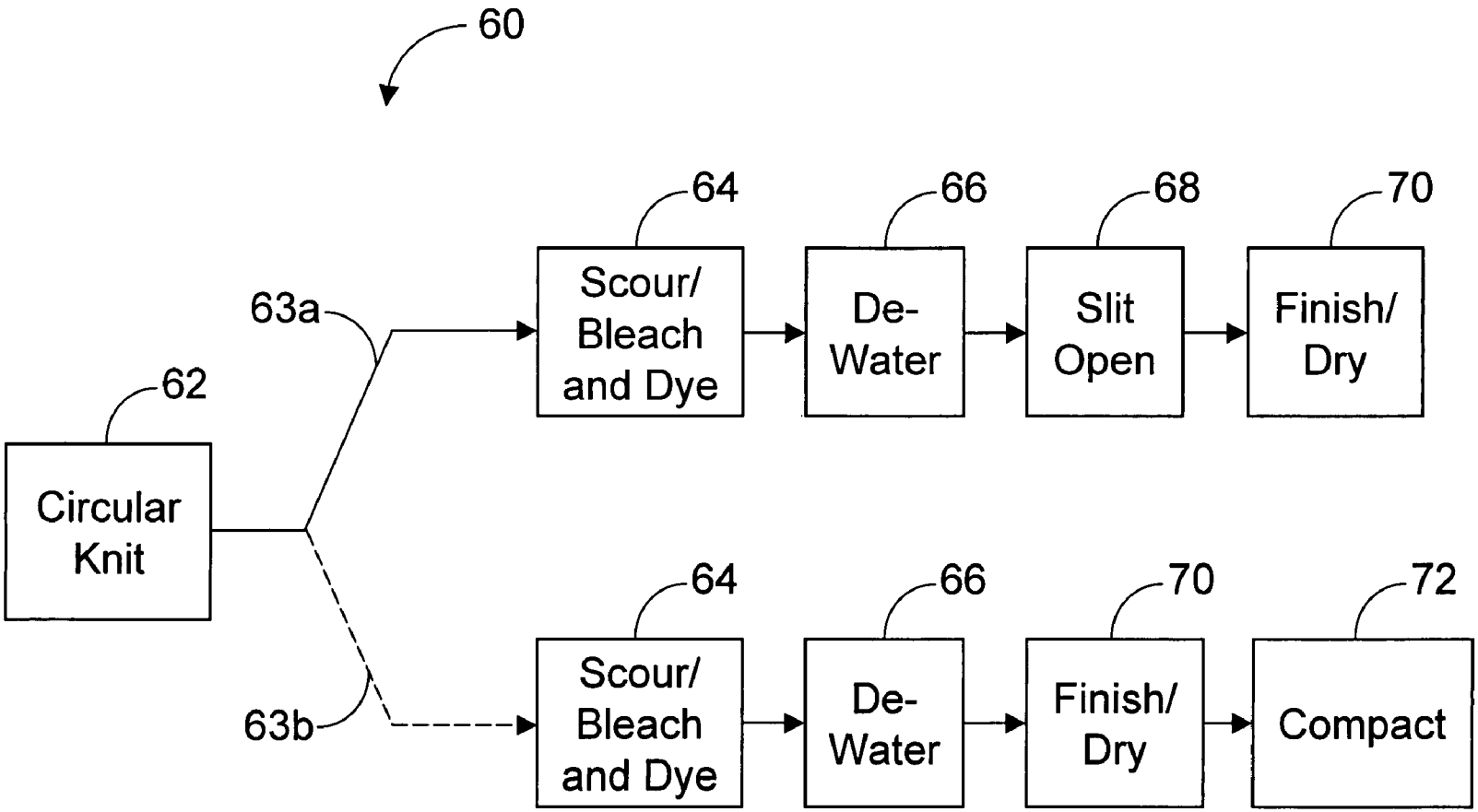
FIG. 5 is a flow chart showing the inventive process steps for making circular knit, elastic, single jersey fabrics that have bare spandex plated in every knit course of one embodiment of the present invention, as described in U.S. Pat. No. 6,776,014.

Knitted fabric Examples except 1, 4, 7, 10, 13, 16, 19, 22, 25, 27, 29, 31, and 33-40 were not hydro-set and were finished either per the open-width process 63*a* or as a tube per the process 63*b* of FIG. 5. Knitted fabric Examples 1, 7, 13, 19, 27, 29 and 31 were finished according to the process in path 63*a*. Knitted fabric Examples 4, 10, 16, 22 and 25 were finished according to the process in path 63*b*. The remaining knitted fabric Examples were scoured and hydro-set (or hydro-set and scoured), dyed and dried, either per the open-width processes 65*a* and 65*c* or as a tube per the process 65*b* and 65*d* of FIG. 6. Knitted fabric Examples 2, 3, 8, 9, 14, 15, 20, 21, 28 and 30 were finished according to the process path 65*a*. Knitted fabric Examples 5, 6, 11, 12, 17, 18, 23, 24 and 26 were finished according to the process path 65*b*. Knitted fabric Example 32 was finished according to the process path 65*c*. Knitted fabric Examples 33 through 40 were finished according to the process path 85*b* of FIG. 7.

Examples 1-32

Fabrics were scoured and bleached in a 300-liter solution at 100° C. for 30 minutes. All such wet, jet finishing, including dyeing, was done in a Tong Geng machine (Taiwan) Model TGRU-HAF-30. The water solution contained Stabilizer SIFA (300 g) (silicate free alkaline), NaOH (45%, 1200 g), $H_2O_2$(35%, 1800 g), IMEROL ST (Clariant, 600 g) for cleaning, ANTIMUSSOL HT2S (Clariant, 150 g) for antifoaming, and IMACOL S (Clariant, 150 g) for anticreasing. After 30 minutes, the solution and fabric were cooled to 75° C. and then the solution was drained. The fabric was subsequently neutralized in a 300 liter solution of water and HAC (150 g) (hydrogen+dona, acetic acid) at 60° C. for 10 minutes. After scouring, new fresh water was added to the jet for the hydro-set step, 74, in FIG. 6. The fabric was run in the jet with water at about 105° C. to about 140° C. for about 15 to about 90 minutes.

The fabrics were dyed in a 300-liter solution of water at 60° C. for 60 minutes, using reactive dyestuffs and other constituents. The dye solution contained R-3BF (Clariant, 215 g), Y-3RF (Clariant, 129 g), $Na_2SO_4$ (18,000 g), and $Na_2CO_3$ (3000 g). After 10 minutes, the dyebath was drained and refilled to neutralize with HAC (150 g) for 10 minutes at 60° C. After neutralization, the bath was again drained and refilled with clean water for a 10-minute rinse. Subsequent to neutralization, the 300-liter vessel was again filled with water, and 150 g of SANDOPUR RSK (Clariant, soap) was added. The solution was, heated to 98° C., and the fabrics were washed/soaped for 10 minutes. After draining and another 10 minute clean-water rinse, the fabrics were unloaded from the vessel.

The wet fabrics were then de-watered by centrifuge, for 8 minutes. For the final step, a lubricant (softener) was padded onto the fabrics in a 77-liter water solution with SANDOPERM SEI liquid (Clariant, 1155g). The fabrics were then dried in a tenter oven at 145° C. for about 30 seconds, at 50% overfeed. The above procedure and additives will be familiar to those experienced in the art of textile manufacturing, and circular knitting of single jersey, French terry, or fleece knit fabrics.

Examples 33-40

Examples 33-40 were bleached and hydro-set in a jet dye machine (Scholl sample jet rd, Scholl-Then, Safenwil, Switzerland) at 95° C. for 20 minutes. The concentration of ingredients in the bleaching solution, based on fabric weight, were as follows: 8% owf hydrogen peroxide, 1% owf Stabilon EZY® (CIBA Specialty Chemicals, High Point, N.C.), and Acetic Acid to neutralize. The liquor ratio was 1:8. The bleaching bath temperature was raised from 49° C. to 95° C. at the rate of 4° C. per minute. The process was operated at 95° C. for 20 minutes, followed by cool down to 63° C. at the cooldown rate of 7° C. per minute. The bleaching bath was then drained and the machine recharged with 49° C. water heated to 77° C., run for 8 minutes, and drained. The bath was charged once again with 49° C. water, neutralized with acetic acid at 77° C. for 8 minutes, and drained. The bath was charged once again with 49° C. water, heated to 120° C. at a rate of 5° per minute and hydro-set for 20 minutes (examples 33, 35, 37, and 39). Examples 34, 36, 38, and 40 were hydro-set at a temperature of 130° C. for 20 minutes. The temperature was cooled at a rate of 7° per minute to 38° C. and drained. The wet fabrics were then de-watered by squeeze rollers, as per normal practice. For Examples 37-40, the fabrics were relax dried at 143° C. with maximum overfeed using a belt relax dryer (Tubetex, Tubular Textile Group, Lexington; N.C.). The fabrics were turned inside out and compacted with steam and 4% overfeed at 149° C. (Tubetex, Tubular Textile Group, Lexington, N.C.). For Examples 33-36, the fabrics were padded with a nap assist (American Textiles Specialties, Spartanburg, S.C.) were relax dried at 143° C. with maximum overfeed using a belt relax dryer (Tubetex, Tubular Textile Group, Lexington, N.C.). The fabrics were napped using a Gessner Lynx double action-tandem napper (The Gessner Company, Chariton, Mass.) for a total of four times on one side. For the final step, The fabrics were compacted with steam at 4% overfeed at 149° C. (Tubetex, Tubular Textile Group, Lexington, N.C.).

Analytical Methods

Spandex Draft—The following procedure, conducted in an environment at 20° C. and 65% relative humidity, is used to measure the spandex drafts in the Examples.

- De-knit (unravel) a yarn sample of 200 stitches (needles) from a single course, and separate the spandex and hard yarns of this sample. A longer sample is de-knit, but the 200 stitches are marked at beginning and end.
- Hang each sample (spandex or hard yarn) freely by attaching one end onto a meter stick with one marking at the top of the stick. Attach a weight to each sample (0.1 g/denier for hard yarn, 0.001 g/denier for spandex). Lower the weight slowly, allowing the weight to be applied to the end of the yarn sample without impact.
- Record the length measured between the marks. Repeat the measurements for 5 samples each of spandex and hard yarn.
- Calculate the average spandex draft according to the following formula:

Draft=(Length of hard yarn between marks)÷(Length of spandex yarn between marks).

If the fabric has been heat set, as in the prior art, it is usually not possible to measure the in-fabric spandex draft. This is because the high temperatures needed for spandex heat setting will soften the spandex yarn surface and the bare spandex will tack to itself at stitch crossover points 16 in the fabric (FIG. 1). Because of such multiple tack points, one cannot de-knit fabric courses and extract yarn samples.

Fabric Weight—Knit Fabric samples are die-punched with a 10 cm diameter die. Each cut-out knit fabric sample is weighed in grams. The "fabric weight" is then calculated as grams/square meters.

Spandex Fiber Content—Knit fabrics are de-knit manually. The spandex is separated from the companion hard yarn and weighed with a precision laboratory balance or torsion balance. The spandex content is expressed as the percentage of spandex weight to fabric weight.

Fabric Elongation—The elongation is measured in the warp direction only. Three fabric specimens are used to ensure consistency of results. Fabric specimens of known length are mounted onto a static extension tester, and weights representing loads of 4 Newtons per centimeter of length are attached to the specimens. The specimens are exercised by hand for three cycles and then allowed to hang free. The extended lengths of the weighted specimens are then recorded, and the fabric elongation is calculated.

Shrinkage—Two specimens, each of 60×60 centimeters, are taken from the knit fabric. Three size marks are drawn near each edge of the fabric square, and the distances between the marks are noted. The specimens are then sequentially machine washed 3 times in a 12-minute washing machine cycle at 40° C. water temperature and air dried on a table in a laboratory environment. The distances between the size marks are then remeasured to calculate the amount of shrinkage.

Face Curl—A 4-inch×4-inch (10.16 cm×10.16 cm) square specimen is cut from the knit fabric. A dot is placed in the center of the square, and an 'X' is drawn with the dot as the center of the 'X'. The legs of the 'X' are 2 (5.08 cm) inches long and in line with the outside corners of the square. The X is carefully cut with a knife, and then the fabric face curls of two of the internal points created by the cut are measured immediately and again in two minutes, and averaged. If the fabric points curl completely in a 360° circle, the curl is rated as 1.0; if it curls only 180°, the curl is rated ½; and so on. Curl values of ¾ or less are acceptable.

Molecular weight analysis—The molecular weight of a spandex fiber can be determined via the following method. An Agilent Technologies 1090 LC (liquid chromatograph, Agilent Technologies, Palo Alto, Calif.), equipped with a UV detector fitted with a 280 nanometer filter in a filter photometric detector and 2 Phenogel™ columns (300 mm×7.8 mm packed with 5 micron column packing of styrene and divinyl benzene in a linear/mixed bed (Phenomex®, Torrance, Calif.), was used to analyze the molecular weight of spandex polymers. Samples were run in mobile phase at a flow rate of 1 ml/min and at a column temperature of 60° C. The sample for analysis is prepared using 2.0-3.0 mg of polymer per ml of solvent. A 50 μl sample of polymer solution was injected into the LC for analysis. The resulting chromatographic data was analyzed using Viscotek 250 GPC software (Viscotek, Houston, Tex.).

The LC was calibrated using a Hamielec Broad standard calibration method and a broad standard was fully characterized for weight average molecular weight (104,000 daltons) and number average molecular weight (33,000 daltons) before use as a standard.

Differential Scanning Calorimetr—This procedure induced four temperatures into the same specimen of spandex without removing the sample from the differential scanning calorimeter (DSC). The DSC instrument was a Perkin Elmer Differential Scanning Calorimeter Model Pyris 1, commercially available from Perkin Elmer (Wellesley, Mass.). The instrument was programmed to start at 50° C. and heat to 140, 160, 180 and 200° C. with a one minute hold at each temperature. The sample was cooled to the starting temperature of 50° C. after each endotherm is scanned, then held at 50° C. for five minutes prior to scanning the next higher temperature.

The specimen was then scanned from 50° C. to 240° C. to locate the endotherms that are induced in the prior test. Each endotherm was found ±3° C. The variance in the endotherms found versus the temperature induced was within the tolerance of the DSC instrument.

Examples

Table 1 below sets forth the knitting conditions for the example knit fabrics. Lycra® types T162C, T169B, or T562B were used for the spandex feeds. Lycra® deniers were 55, 40 and 20, or 61 dtex, 44 dtex and 22 dtex, respectively. For examples 29-32, the # of filaments was 72, the Denier per filament was 1.39, and the drying temperature was 130° C. The stitch length, L, was a machine setting. Machine gauge was 28 needles per inch. Table 2 below summarizes key results of the tests for finished fabrics. Values of curl were acceptable for all test conditions, and will not be further discussed below. Spandex feed tensions are listed in grams. 1.00 gram equals 0.98 centiNewtons (cN).

TABLE 1

KNITTING CONDITIONS

| Example | Lycra ® Type | Lycra ® Denier | Hard Yarn Type | Hard Yarn count, Nm | Stitch Length, L in mm | Cover Factor, Cf | Lycra ® Feed Tension, grams | Machine Gauge, needles per inch |
|---|---|---|---|---|---|---|---|---|
| 1 | T169B | 20 | Cotton | 54.5 | 3.06 | 1.40 | 1.50 | 28 |
| 2 | T169B | 20 | Cotton | 54.5 | 3.06 | 1.40 | 1.50 | 28 |
| 3 | T169B | 20 | Cotton | 54.5 | 3.06 | 1.40 | 1.50 | 28 |
| 4 | T169B | 20 | Cotton | 54.5 | 3.06 | 1.40 | 1.50 | 28 |
| 5 | T169B | 20 | Cotton | 54.5 | 3.06 | 1.40 | 1.50 | 28 |
| 6 | T169B | 20 | Cotton | 54.5 | 3.06 | 1.40 | 1.50 | 28 |
| 7 | T562B | 20 | Cotton | 54.5 | 3.06 | 1.40 | 2.05 | 28 |
| 8 | T562B | 20 | Cotton | 54.5 | 3.06 | 1.40 | 2.05 | 28 |
| 9 | T562B | 20 | Cotton | 54.5 | 3.06 | 1.40 | 2.05 | 28 |
| 10 | T562B | 20 | Cotton | 54.5 | 3.06 | 1.40 | 2.05 | 28 |
| 11 | T562B | 20 | Cotton | 54.5 | 3.06 | 1.40 | 2.05 | 28 |
| 12 | T5628 | 20 | Cotton | 54.5 | 3.06 | 1.40 | 2.05 | 28 |
| 13 | T169B | 20 | Nylon | 64 | 3.06 | 1.29 | 1.70 | 28 |
| 14 | T169B | 20 | Nylon | 64 | 3.06 | 1.29 | 1.70 | 28 |
| 15 | T169B | 20 | Nylon | 64 | 3.06 | 1.29 | 1.70 | 28 |
| 16 | T169B | 20 | Nylon | 64 | 3.06 | 1.29 | 1.70 | 28 |
| 17 | T169B | 20 | Nylon | 64 | 3.06 | 1.29 | 1.70 | 28 |
| 18 | T169B | 20 | Nylon | 64 | 3.06 | 1.29 | 1.70 | 28 |
| 19 | T562B | 20 | Nylon | 64 | 3.06 | 1.29 | 2.90 | 28 |
| 20 | T562B | 20 | Nylon | 64 | 3.06 | 1.29 | 2.90 | 28 |
| 21 | T562B | 20 | Nylon | 64 | 3.06 | 1.29 | 2.90 | 28 |
| 22 | T562B | 20 | Nylon | 64 | 3.06 | 1.29 | 2.90 | 28 |
| 23 | T562B | 20 | Nylon | 64 | 3.06 | 1.29 | 2.90 | 28 |
| 24 | T562B | 20 | Nylon | 64 | 3.06 | 1.29 | 2.90 | 28 |
| 25 | T562B | 20 | Cotton | 54.5 | 3.06 | 1.40 | | 28 |
| 26 | T562B | 20 | Cotton | 54.5 | 3.06 | 1.40 | | 28 |
| 27 | T562B | 40 | Cotton | 54.5 | 3.06 | 1.40 | | 28 |
| 28 | T562B | 40 | Cotton | 54.5 | 3.06 | 1.40 | | 28 |
| 29 | T162C | 55 | Polypropylene | 90 | 2.91 | 1.14 | | 28 |
| 30 | T162C | 55 | Polypropylene | 90 | 2.91 | 1.14 | | 28 |
| 31 | T162C | 70 | Polypropylene | 90 | 2.91 | 1.14 | | 24 |
| 32 | T162C | 70 | Polypropylene | 90 | 2.91 | 1.14 | | 24 |
| 33 | T562B | 30 | Cotton (2ends) | 50 & 34 | 3.07 | 1.45 | | 20 |
| 34 | T562B | 30 | Cotton (2ends) | 50 & 34 | 3.07 | 1.45 | | 20 |
| 35 | T562B | 20 | Cotton (2ends) | 50 & 34 | 3.07 | 1.45 | | 20 |
| 36 | T562B | 20 | Cotton (2ends) | 50 & 34 | 3.07 | 1.45 | | 20 |
| 37 | T562B | 30 | Cotton (2ends) | 50 & 34 | 3.07 | 1.45 | | 20 |
| 38 | T562B | 30 | Cotton (2ends) | 50 & 34 | 3.07 | 1.45 | | 20 |
| 39 | T562B | 20 | Cotton (2ends) | 50 & 34 | 3.07 | 1.45 | | 20 |
| 40 | T562B | 20 | Cotton (2ends) | 50 & 34 | 3.07 | 1.45 | | 20 |

TABLE 2

RESULTS

| Example | Lycra ® Draft | Lycra ® Content in Fabric by % weight | Open Width/ Tube | Hydro-set Temp ° C. | Hydro-set Time Minutes | Basis Weight, g/m$^2$ | Maximum Elongation, % Length × Width | Shrinkage %, Warp by Weft | Face Curl, Fraction of 360° |
|---|---|---|---|---|---|---|---|---|---|
| 1 | 2 | 6 | OW | None | None | 219 | 112 × 150 | −3 × −3 | ½ |
| 2 | 2 | 6 | OW | 110 | 5 | 219 | 115 × 158 | −2 × −3 | ½ |
| 3 | 2 | 6 | OW | 130 | 15 | 194 | 95 × 155 | −3 × −3 | ½ |
| 4 | 2 | 6 | Tube | None | None | 232 | 97 × 153 | −3 × 2 | ⅜ |
| 5 | 2 | 6 | Tube | 110 | 5 | 229 | 98 × 144 | −3 × 2 | ⅜ |
| 6 | 2 | 6 | Tube | 130 | 15 | 206 | 80 × 143 | −3 × 3 | ¼ |
| 7 | 2 | 6 | OW | None | None | 220 | 115 × 156 | −2 × −3 | ½ |
| 8 | 2 | 6 | OW | 110 | 5 | 210 | 108 × 156 | −2 × −2 | ½ |
| 9 | 2 | 6 | OW | 130 | 15 | 171 | 74 × 154 | −1 × −1 | ⅜ |
| 10 | 2 | 6 | Tube | None | None | 229 | 98 × 156 | −3 × 2 | ½ |
| 11 | 2 | 6 | Tube | 110 | 5 | 225 | 97 × 149 | −2 × 2 | ½ |
| 12 | 2 | 6 | Tube | 130 | 15 | 173 | 57 × 151 | −4 × 4 | ½ |
| 13 | 2 | 7 | OW | None | None | 242 | 97 × 123 | −3 × −2 | ⅛ |
| 14 | 2 | 7 | OW | 110 | 5 | 244 | 93 × 117 | −3 × −2 | 0 |
| 15 | 2 | 7 | OW | 130 | 15 | 238 | 71 × 95 | −2 × −4 | ¼ |
| 16 | 2 | 7 | Tube | None | None | 254 | 97 × 135 | −2 × 0 | ⅛ |
| 17 | 2 | 7 | Tube | 110 | 5 | 258 | 92 × 129 | −1 × 0 | 0 |
| 18 | 2 | 7 | Tube | 130 | 15 | 251 | 69 × 106 | −1 × 0 | 0 |
| 19 | 2 | 7 | OW | None | None | 248 | 104 × 120 | −3 × −2 | 0 |
| 20 | 2 | 7 | OW | 110 | 5 | 244 | 98 × 118 | −2 × −2 | 0 |
| 21 | 2 | 7 | OW | 130 | 15 | 209 | 63 × 86 | −2 × −1 | ½ |
| 22 | 2 | 7 | Tube | None | None | 260 | 103 × 130 | −2 × 0 | ⅛ |
| 23 | 2 | 7 | Tube | 110 | 5 | 258 | 100 × 129 | −2 × 0 | 0 |
| 24 | 2 | 7 | Tube | 130 | 15 | 220 | 62 × 102 | −2 × 0 | ⅛ |
| 25 | 3 | 4 | Tube | None | None | 300 | 155 × 169 | −2 × 1 | ¼ |
| 26 | 3 | 4 | Tube | 130 | 15 | 189 | 88 × 178 | −7 × −4 | ⅝ |
| 27 | 2 | 12 | OW | None | None | 285 | 144 × 138 | −1 × −1 | ½ |
| 28 | 2 | 12 | OW | 130 | 15 | 220 | 101 × 136 | 0 × −2 | ½ |
| 29 | 2.5 | 18 | OW | None | None | 302 | 173 × 152 | 0 × −5 | ½ |
| 30 | 2.5 | 18 | OW | 130 | 15 | 293 | 163 × 167 | 0 × −2 | ⅛ |
| 31 | 2 | 27 | OW | None | None | 268 | 160 × 136 | 0 × −2 | ⅞ |
| 32 | 2 | 27 | OW | 130 | 15 | 267 | 153 × 140 | 0 × −1 | ⅛ |
| 33 | 1.9 | 5 | Tube | 120 | 20 | 266 | 50 × 68 | −12 × −8 | 0 |
| 34 | 1.9 | 5 | Tube | 130 | 20 | 229 | 37 × 59 | −15 × −3 | 0 |
| 35 | 1.9 | 3.5 | Tube | 120 | 20 | 249 | 45 × 61 | −15 × −7 | 0 |
| 36 | 1.9 | 3.5 | Tube | 130 | 20 | 219 | 34 × 66 | −12 × −4 | 0 |
| 37 | 1.9 | 5 | Tube | 120 | 20 | 293 | 60 × 102 | −6 × −6 | 0 |
| 38 | 1.9 | 5 | Tube | 130 | 20 | 261 | 57 × 85 | −4 × −1 | 0 |
| 39 | 1.9 | 3.5 | Tube | 120 | 20 | 268 | 57 × 102 | −5 × −5 | 0 |
| 40 | 1.9 | 3.5 | Tube | 130 | 20 | 245 | 48 × 93 | −3 × −5 | 0 |

Examples

Example 1

The 20-denier spandex feed tension was 1.5 grams (1.47 cN), which is in the range of 4 to 6 cN. The hard yarn in this example was ring-spun cotton (32 Ne, 165 denier). The fabric was dyed and finished according to the process 63*a* schematically shown in FIG. 5. The fabric is slit and dried open width as in 63*a*.

Example 2

The knit fabric of Example 1 was treated with hot water (230° F. or 110° C.) for 5 minutes in a jet dyer and dyed and finished similarly to Example 1, FIG. 6 as in process path 65*a*, including the hydro-setting step 74. The finished fabric in Example 2 has the same basis weight (weight), elongation, shrinkage, and face curl as the knit fabric in Example 1 even though a hydro-setting step was used to finish the fabric. This example illustrates that even at hydro-setting temperatures, 5 minutes of exposure to hydro setting is not sufficient to change the fabric properties.

Example 3

The knit fabric of Example 1 was treated with hot water (266° F. or 130° C.) for 15 minutes in a jet dyer and dyed and finished similarly to Example 2. The finished fabric in Example 3 had a basis weight of 194 g/m$^2$, which is 11% lower than Example 1.

Example 4

The knit fabric of Example 1 was dyed and finished according to the process schematically shown in FIG. 5. The fabric was dried in tubular form as in process path 63*b*. Because the desired fabric weight for tubular goods is around 200 g/m$^2$, this process produced a fabric with excessive weight (232 g/m$^2$), even though all other fabric properties were desirable.

Example 5

The knit fabric of Example 1 was treated with hot water (230° F. or 110° C.) for 5 minutes in a jet dyer and dyed and finished similarly to Example 4, FIG. 6, as in process path 65*b*, including the tubular hydro-setting 74. The finished fabric in Example 5 had a basis weight that was only 1% lower than the fabric in Example 4. Maximum length elongation, shrinkage, and face curl for Example 5 were the same as the knit fabric in Example 4 even though a hydro-setting step was used to finish the fabric. This example illustrates that even at hydro-setting process conditions (elevated temperature and pressure), 5 minutes of exposure to hydro setting is not sufficient to change the fabric properties.

Example 6

The knit fabric of Example 1 was treated with hot water (266° F. or 130° C.) for 15 minutes in a jet dyer and dyed and finished similarly to Example 5. The finished fabric in Example 6 had a basis weight of 206 g/m$^2$, which is 10% lower than Example 4 and acceptable for a tubular T-shirt garment.

Example 7

Process parameters were the same as in Example 1, except that a different spandex yarn, Lycra® Type 562B ('easy-set') was used for the spandex feed. The results were comparable to the fabric in Example 1.

Example 8

The knit fabric of Example 7 was treated with hot water (230° F. or 110° C.) for 5 minutes in a jet dyer and dyed and finished similarly to Example 1, FIG. 6, as in process path 65*a*, including the tubular hydro setting step 74. The finished fabric in Example 8 had a basis weight that was only 5% lower than the fabric in Example 7. Maximum length elongation, shrinkage, and face curl for Example 8 were similar to the knit fabric in Example 7 even though a hydro-setting step was used to finish the fabric. This example illustrates that even at hydro-setting temperatures, 5 minutes of exposure to hydro setting is not sufficient to change the fabric properties.

Example 9

The knit fabric of Example 7 was treated with hot water (266° F. or 130° C.) for 15 minutes in a jet dyer and dyed and finished similarly to Example 1. The knit fabric was processed according to FIG. 6, process path 65*a*, to give an open width fabric. This spandex is more sensitive to heat than other grades of Lycra® brand spandex; thus, the basis weight for the fabric in Example 9 was 171 g/m$^2$, which is 19% lower than the fabric in example 7. Elongation, shrinkage, and fabric face curl were acceptable for making T-shirts.

Example 10

The knit fabric of Example 7 was dyed and finished according to the process schematically shown in FIG. 5. The fabric was dried in tubular form as in process path 63*b*. Because the desired fabric weight for tubular goods is around 200 g/m$^2$, this process produced a fabric with excessive weight (229 g/m$^2$), even though all other fabric properties were desirable.

Example 11

The knit fabric of Example 7 was treated with hot water (230° F. or 110° C.) for 5 minutes in a jet dyer and dyed and finished similarly to Example 4, FIG. 6 as in process path 65*b*, including the tubular hydro setting step 74. The finished fabric in Example 11 had a basis weight that was only 2% lower than the fabric in Example 10. Maximum length elongation, shrinkage, and face curl for Example 11 were the same as the knit fabric in Example 10 even though a hydro-setting step was used to finish the fabric. This example illustrates that even at hydro-setting temperatures, 5 minutes of exposure to hydro setting is not sufficient to change the fabric properties.

Example 12

The knit fabric of Example 7 was treated with hot water (266° F. or 130° C.) for 15 minutes in a jet dyer and dyed and finished similarly to Example 11. The finished fabric in Example 12 had a basis weight of 173 g/m$^2$, which is 23% lower than Example 7 and acceptable for a tubular T-shirt garment.

Example 13

The 20-denier spandex feed tension was 1.70 grams (1.67 cN), which is in the range of 4 to 6 cN. The hard yarn in this example was textured nylon (140 denier/48 filaments). The fabric was dyed and finished according to FIG. 5. The fabric was slit and dried open width as in process path 63*a*.

Example 14

The knit fabric of Example 13 was treated with hot water (230° F. or 110° C.) for 5 minutes in a jet dyer and dyed and finished similarly to Example 13, FIG. 6, process path 65*a* including the hydro setting step 74. The finished fabric in Example 14 had the same basis weight (weight), elongation, shrinkage, and face curl as the knit fabric in Example 13 even though a hydro-setting step was used to finish the fabric. This example illustrates that even at hydro-setting temperatures, 5 minutes of exposure to hydro setting is not sufficient to change the fabric properties.

Example 15

The knit fabric of Example 13 was treated with hot water (266° F. or 130° C.) for 15 minutes in a jet dyer and dyed and finished similarly to Example 14. The finished fabric in Example 15 had warp elongation that was reduced significantly (>25%) versus the finished fabric in Example 13.

Example 16

The knit fabric of Example 13 was dyed and finished according to method schematically shown in FIG. 5. The fabric was dried in the tubular form as in process path 63*b*.

Example 17

The knit fabric of Example 13 was treated with hot water (230° F. or 110° C.) for 5 minutes in a jet dyer and dyed and finished similarly to Example 16, FIG. 6, process path 65*b* including the tubular hydro setting step 74. The finished fabric in Example 17 had a warp elongation that was only 5% lower than Example 16. Fabric basis weight, shrinkage, and face curl for Example 17 were essentially the same as the knit fabric in Example 16 even though a hydro-setting step is used to finish the fabric. This example illustrates that even at hydro-setting temperatures, 5 minutes of exposure to hydro setting is not sufficient to change the fabric properties.

Example 18

The knit fabric of Example 13 was treated with hot water (266° F. or 130° C.) for 15 minutes in a jet dyer and dyed and finished similarly to Example 17. The finished fabric in Example 18 had a warp elongation of 69%, which was 28% lower than Example 16 and acceptable for a tubular T-shirt garment. Fabric basis weight, shrinkage, and face curl also were essentially the same as Example 16.

Example 19

Process parameters were the same as in Example 13, except that a different spandex yarn, Lycra® Type 562B ('easy-set') was used for the spandex feed. The results were comparable to those of Example 13.

Example 20

The knit fabric of Example 19 was treated with hot water (230° F. or 110° C.) for 5 minutes in a jet dyer and dyed and finished similarly to Example 19, FIG. 6, process path 65*a* including the tubular hydro setting step 74. The finished fabric in Example 20 had a basis weight that was only 2% lower than that of Example 19. Maximum length elongation, shrinkage, and face curl for Example 20 were similar to the knit fabric in Example 19 even though a hydro-setting step was used to finish the fabric. This example illustrates that even at hydro-setting temperatures, 5 minutes of exposure to hydro setting is not sufficient to change the fabric properties.

Example 21

The knit fabric of Example 19 was treated with hot water (266° F. or 130° C.) for 15 minutes in a jet dyer and dyed and finished similarly to Example 20. The knit fabric was processed according to FIG. 6, process path 65*a*, to give an open width fabric. This spandex is more sensitive to heat than other grades of Lycra® brand spandex; thus, the basis weight for the fabric in Example 21 was 209 g/m$^2$, which is 14% lower than the fabric in Example 19.

Example 22

The knit fabric of Example 19 was dyed and finished according to the process schematically shown in FIG. 5. The fabric was dried in a tubular form as in process path 63*b*. This process produced a fabric with excessive weight (260 g/m$^2$), even though all other fabric properties were desirable.

Example 23

The knit fabric of Example 19 was treated with hot water (230° F. or 110° C.) for 5 minutes in a jet dyer and dyed and finished similarly to Example 22, FIG. 6, process path 65*b* including the tubular hydro setting step 74. The finished fabric in Example 23 had a basis weight that was only 1% lower than the fabric in Example 22. Maximum length elongation, shrinkage, and face curl for Example 23 were the same as the knit fabric in Example 22 even though a hydro-setting step was used to finish the fabric. This example illustrates that even at hydro-setting temperatures, 5 minutes of exposure to hydro setting is not sufficient to change the fabric properties.

Example 24

The knit fabric of Example 19 was treated with hot water (266° F. or 130° C.) for 15 minutes in a jet dyer and dyed and finished similarly to Example 23. The finished fabric in Example 24 had a basis weight of 220 g/m$^2$, which is 15% lower than the fabric of Example 22.

Example 25

The 20-denier spandex draft was 3.0×. The hard yarn in this example was ring-spun cotton (32 Ne, 165 denier). The fabric was dyed and finished according to the process schematically shown in FIG. 5. The fabric was dried in a tubular form as in process path 63*b*.

Example 26

The knit fabric of Example 25 was treated with hot water (266° F. or 130° C.) for 15 minutes in a jet dyer and dyed and finished similarly to Example 25, FIG. 6, process path 65*b*, including the tubular hydro setting step 74. The finished fabric in Example 26 had a basis weight that was 37% lower than the fabric in Example 25.

Example 27

The 40-denier spandex draft was 2.0×. The hard yarn in this example was ring-spun cotton (32 Ne, 165 denier). The fabric was dyed and finished according to the process schematically shown in FIG. 5. The fabric was slit and dried open width as in process path 63*a*.

Example 28

The knit fabric of Example 27 was treated with hot water (266° F. or 130° C.) for 15 minutes in a jet dyer and dyed and finished similarly to Example 27, FIG. 6, process path 65*a*, including the tubular hydro setting step 74. The finished fabric in Example 28 had a basis weight that was 23% lower than the fabric in Example 25.

Example 29

The hard yarn in this example was textured polypropylene (100 denier, 110 decitex, 1.39 denier/filament). The spandex was Lycra® T162C (55 denier, 61 decitex) drafted at 2.5×. The fabric was dyed and finished according to path 63*a*, FIG. 5.

Example 30

The knit fabric of Example 29 was treated with hot water (266° F. or 130° C.) for 15 minutes by hydro-setting in a jet dyer 74 and dried, path 65*a*, FIG. 6.

Example 31

The hard yarn in this example was textured polypropylene (100 denier, 110 decitex, 1.39 denier/filament). The spandex was Lycra® T162C (70 denier, 78 decitex) drafted at 2.0×. The fabric was dyed and finished according to path 63*a*, FIG. 5.

Example 32

The knit fabric of Example 31 was treated with hot water (266° F. or 130° C.) for 15 minutes by hydro-setting in a jet dyer 74 and dried as in path 65*c*, FIG. 6.

Example 33

A two end French terry fabric was knit in this example using 100% cotton 30/1 Ne yarn for the jersey feeds and 100% cotton 20/1 Ne yarns for the loops. Jersey feeds were plated with 33 dtex T562B Lycra® at a draft of 1.9×. Fabrics were wet processed (including a hydroheat set at 120° C. for 20 minutes) and napped to give a single-sided fleece finished fabric according to path 85*b* of FIG. 7.

Example 34

The fabric of Example 33 was wet processed (including a hydroheat set at 130° C. for 20 minutes) and napped to give a single-sided fleece finished fabric according to path 85*b* of FIG. 7.

Example 35

A two end French terry fabric was knit in this example using 100% cotton 30/1 Ne yarn for the jersey feeds and 100% cotton 20/1 Ne yarns for the loops. Jersey feeds were plated with 22 dtex T562B Lycra® at a draft of 1.9×. Fabrics were wet processed including a hydroheat set at 120° C. for 20 minutes) and napped to give a single-sided fleece finished fabric according to path 85*b* of FIG. 7.

Example 36

The fabric of Example 35 was wet processed (including a hydroheat set at 130° C. for 20 minutes) and napped to give a single-sided fleece finished fabric according to path 85*b* of FIG. 7.

Example 37

A two end French terry fabric was knit in this example using 100% cotton 30/1 Ne yarn for the jersey feeds and 100% cotton 20/1 Ne yarns for the loops. Jersey feeds were plated with 33 dtex T562B Lycra® at a draft of 1.9×. Fabrics were wet processed to give a French terry finished fabric according to path 85*b* of FIG. 7.

Example 38

The fabric of Example 37 was wet processed to give French terry finished fabric according to path 85*b* of FIG. 7.

Example 39

A two end French terry fabric was knit in this example using 100% cotton 30/1 Ne yarn for the jersey feeds and 100% cotton 20/1 Ne yarns for the loops. Jersey feeds were plated with 22 dtex T562B Lycra® at a draft of 1.9×. Fabrics were wet processed to give a French terry finished fabric according to path 85*b* of FIG. 7.

Example 40

The fabric of Example 39 was wet to give a French terry finished fabric according to path 85*b* of FIG. 7.

Thus it should be apparent that there has been provided in accordance with the present invention a useful circular knit, elastic fabrics of at least one of single jersey, French terry, and fleece having a bare elastomeric material plated with spun and/or continuous filament hard yarns, as well as methods of producing same that do not require a dry heat setting step, that fully satisfies the objectives and advantages set forth above. Although the invention has been described in conjunction with specific embodiments thereof; it is evident that many alternatives, modifications, and variations will be apparent to those skilled in the art. Accordingly, it is intended to embrace all such alternatives, modifications, and variations that fall within the spirit and broad scope of the appended claims.

What is claimed is:

1. A method for making a circular knit, elastic, single jersey fabric, the method comprising the steps of:

providing an elastomeric material;

providing at least one hard yarn selected from the group consisting of spun yarns, continuous filament yarns, and combinations thereof;

plating the elastomeric material with the at least one hard yarn;

circular knitting the plated elastomeric material and at least one hard yarn in every knit course to form a circular knit, elastic, single jersey fabric; and contacting the circular knit, elastic, single jersey fabric with a continuous phase aqueous solution under conditions of temperature and pressure and for a period of time sufficient to substantially set the elastomeric material.

2. The method of claim 1 wherein, in the step of providing an elastomeric material, the elastomeric material is further defined as bare spandex yarn.

3. The method of claim 1 wherein, in the step of providing an elastomeric material, the elastomeric material is further defined as bare spandex yarn from about 15 to about 156 dtex.

4. The method of claim 1 wherein, in the step of providing at least one hard yarn, the at least one hard yarn is further defined as a hard yarn having a yarn count (Nm) from about 10 to about 165.

5. The method of claim 1 wherein, in the step of circular knitting the plated elastomeric material and at least one hard yarn in every knit course to form a circular knit, elastic, single jersey fabric, the circular knit, elastic, single jersey fabric has a cover factor of from about 1.05 to about 1.9.

6. The method of claim 1, further comprising the step of exposing the circular knit, elastic, single jersey fabric to at least one further treatment step, wherein such treatment step occurs at a temperature below a temperature required to heat set the elastomeric material.

7. The method of claim 6, wherein the circular knit, elastic, single jersey fabric is exposed to a temperature below about 160° C. during the at least one further treatment step.

8. The method of claim 6, wherein the at least one further treatment step is selected from the group consisting of cleaning, bleaching, dyeing, drying, compacting, and any combination thereof.

9. The method of claim 8, wherein the at least one further treatment step is selected from the group consisting of drying, compacting, and combinations thereof, and wherein the circular knit, elastic, single jersey fabric is subjected to an overfeed in its length during the at least one further treatment step.

10. The method of claim 1, wherein the circular knit, elastic, single jersey fabric has an elastomeric content of from about 3.5% to about 30% by weight based on the total fabric weight per square meter.

11. The method of claim 1 wherein, in the step of providing at least one hard yarn, the at least one hard yarn is selected from the group consisting of synthetic filament, spun staple yarn of natural fibers, natural fibers blended with synthetic fibers or yarns, spun staple yarn of cotton, cotton blended with synthetic fibers or yarns, spun staple polypropylene, polyethylene or polyester blended with polypropylene, polyethylene or polyester fibers or yarns, and combinations thereof.

12. The method of claim 11 wherein the at least one hard yarn is a heat sensitive yarn.

13. The method of claim 1, wherein the at least one hard yarn is selected from the group consisting of cotton and a cotton blend, and the circular knit, elastic, single jersey fabric has a basis weight of from about 100 to about 500 g/m$^2$.

14. The method of claim 1, wherein the circular knit, elastic, single jersey fabric has an elongation of at least about 60% in a warp direction thereof.

15. The method of claim 1, wherein the circular knit, elastic, single jersey fabric has a shrinkage of about 14% or less after washing.

16. The method of claim 1, wherein the circular knit, elastic, single jersey fabric is produced in the form of a tube and has substantially no visible side creases formed therein.

17. The method of claim 1 wherein, in the step of contacting the circular knit, elastic, single jersey fabric with a continuous phase aqueous solution, the temperature is in a range of from about 105° C. to about 145° C.

18. The method of claim 1 wherein, in the step of contacting the circular knit, elastic, single jersey fabric with a continuous phase aqueous solution, the period of time is in a range of from about 5 minutes to about 90 minutes.

19. The method of claim 1 wherein, in the step of circular knitting the plated elastomeric material and at least one hard yarn, the feed of the elastomeric material is controlled so that the elastomeric material is drafted no more than about 7× its original length when knit to form the circular knit, elastic, single jersey fabric.

* * * * *